US012428183B1

(12) United States Patent
Ochs et al.

(10) Patent No.: US 12,428,183 B1
(45) Date of Patent: Sep. 30, 2025

(54) SYSTEMS AND METHODS FOR FORMING CAVITY TO RETAIN ITEM(S) DURING PACKAGING

(71) Applicant: Amazon Technologies, Inc., Seattle, WA (US)

(72) Inventors: Garett Ochs, Seattle, WA (US); Terin Thomas, Kirkland, WA (US)

(73) Assignee: Amazon Technologies, Inc., Seattle, WA (US)

( * ) Notice: Subject to any disclaimer, the term of this patent is extended or adjusted under 35 U.S.C. 154(b) by 91 days.

(21) Appl. No.: 18/127,412

(22) Filed: Mar. 28, 2023

(51) Int. Cl.

| | |
|---|---|
| ***B65B 11/00*** | (2006.01) |
| ***B65B 11/12*** | (2006.01) |
| ***B65B 49/14*** | (2006.01) |
| ***B65B 51/10*** | (2006.01) |
| ***B65B 61/02*** | (2006.01) |

(52) U.S. Cl.
CPC ..... *B65B 11/12* (2013.01); *B65B 49/14* (2013.01); *B65B 51/10* (2013.01); *B65B 61/02* (2013.01)

(58) Field of Classification Search
CPC ..... B65B 11/10; B65B 2210/04; B65B 5/024; B65B 43/10; B65B 5/06
USPC ..... 53/452, 455, 456, 443, 445
See application file for complete search history.

(56) References Cited

U.S. PATENT DOCUMENTS

| | | | | |
|---|---|---|---|---|
| 4,817,366 | A * | 4/1989 | Konzal | B29C 66/9292 53/551 |
| 2015/0360801 | A1* | 12/2015 | Sytema | B65B 49/16 53/74 |
| 2016/0185065 | A1* | 6/2016 | Sytema | B65B 5/024 493/183 |
| 2018/0134421 | A1* | 5/2018 | Ponti | B65B 43/10 |
| 2020/0377278 | A1* | 12/2020 | Orsini | B65B 55/20 |

* cited by examiner

*Primary Examiner* — Jacob A Smith
(74) *Attorney, Agent, or Firm* — Athorus, PLLC

(57) ABSTRACT

A method includes causing, via a cutting mechanism, creases to be formed within a packaging material, causing one or more items to be deposited on the packaging material, causing, via a folding mechanism, at least a first side and a second side of the packaging material to be folded to at least partially form a cavity in which the one or more items reside, causing, via a conveyance mechanism, at least a first end and a second end of the packaging material to be folded to at least partially form the cavity, causing the first side and the second side to be sealed, causing, via the conveyance mechanism, the packaging material to be conveyed to a sealing mechanism, and causing, via the sealing mechanism, the first end and the second end to be sealed.

20 Claims, 24 Drawing Sheets

SYSTEMS AND METHODS FOR FORMING CAVITY TO RETAIN ITEM(S) DURING PACKAGING

BACKGROUND

The rise of ecommerce has brought about an increase in order fulfillment, packaging, processing, and shipment. To meet these demands, automated machines and systems have been developed that package item(s) for shipment. In some cases, the automated machines may individually construct boxes for the item(s) being shipped. However, securely manufacturing the boxes around the item(s) remains a challenge. For example, portions of the box may open and/or the item(s) may spill out during construction. Such occurrences have a negative impact on order fulfillment and throughput.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features. The systems depicted in the accompanying figures are not to scale and components within the figures may be depicted not to scale with each other.

DETAILED DESCRIPTION

Figure 1:
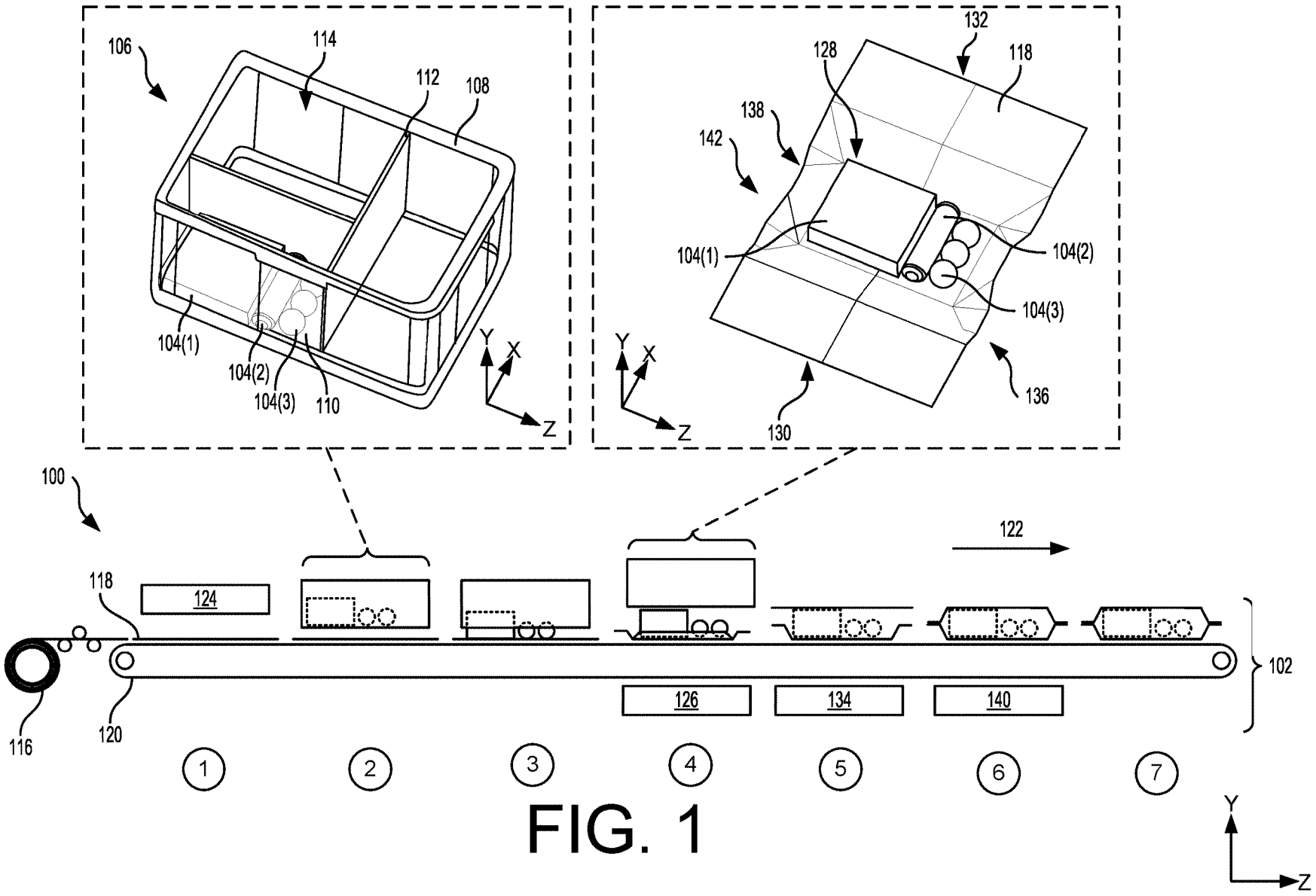
FIG. 1 illustrates an example environment including an example machine having an example folding mechanism for folding portions of a container around item(s) and an example sealing mechanism for sealing the container around the item(s), according to examples of the present disclosure.

This patent application is directed, at least in part, to a machine having a folding mechanism for at least partially forming a container around one or more item(s), and/or a sealing mechanism for sealing the container. In some instances, item(s) being processed for shipment may be arrive at the machine within a tote. The tote may have an actuatable bottom for depositing the item(s) onto a portion of a material that forms the container. The folding mechanism may fold sides of the material inward to form a cavity for the item(s) and retain the item(s) within the cavity. The material may include creases that facilitate formation of the cavity and folding of the material. After folding portions of the material, a conveyance mechanism of the machine may transfer the material from the folding mechanism to the sealing mechanism. During transport, the conveyance mechanism may include members, such as pins, for example, that prevent the material unfolding. In doing so, the item(s) are retained within the cavity. The sealing mechanism, meanwhile, presses, adheres, and/or otherwise secures portions of the material together. For example, the sealing mechanism may include presses that cinch ends of the material together. As a result, the items may be secured within the container formed by the material and item throughput may be increased.

As orders are placed, item(s) associated with the order may be picked from an inventory of item(s) (e.g., shelving, storage, etc.). The item(s) may include, or represent, any suitable items, such as books, gadgets, jewelry, home decor, and so forth. In some instances, the picked item(s) may be placed within a tote (e.g., bin, container, etc.). The tote may include a top, which is open to receive the item(s), one or more sidewalls that form an exterior of the tote, and an actuatable bottom that moves between an open position and a closed position. The tote also includes one or more partitions disposed within tote, between the sidewalls, and which at least partially define a compartment of the tote. For example, the one or more partitions of the tote may be moveable to form the compartment in which the item(s) are placed. The compartment may be sized based on a size of the item(s), and the partitions may be moveable to compactly fit around the item(s). Sizing the compartment according to the item(s) within the tote may lessen material waste when forming the container. As such, by compactly packaging the item(s) within the container, less material may be used to form the container.

The size of the container formed by the material may be dependent upon the size of the compartment of the tote. For example, the size of the compartment may be used to cut an appropriate size of the material that is used to form the container. Additionally, the creases may be formed within or on the material based on a size of the container (or the cavity) to be formed. For example, depending upon the size of the cavity to be formed, or the size and/or number of item(s) to be packaged, the creases may be variably formed on the material. In some instances, the creases are formed within or on the material prior to the tote depositing the item(s) onto the material. Any number of creases may be formed within the material, the creases may be formed across various lengths or widths of the material, at various angles, and so forth. Details of the creases are discussed herein, however, generally the creases facilitate the formation of the container and the cavity to retain the item(s) therein as the container is formed. For example, as used herein, the creases may represent any deformation, cuts, perforation, etc. of the material that facilitates a physical manipulation of the material.

The tote deposits the item(s) onto the material via actuation of the bottom. For example, in the closed position of the actuatable bottom, the item(s) may reside within the compartment and rest on the actuatable bottom. However, the actuatable bottom may be moved to the open position, causing the item(s) to fall out of the compartment (or the tote) and onto the material. As the item(s) are deposited onto the material the tote may reside vertically above the material and the item(s) may be constrained from rolling off the material, for example, via an engagement between the item(s) and the sidewalls and/or the partitions of the tote.

That is, sides of the item(s) may be in contact with the sidewalls and/or the partitions to prevent the item(s) rolling off the material. The item(s) are placed onto a portion of the material corresponding to a location at which the cavity is formed in the material.

After depositing the item(s), the tote may be translated vertically upward and away from the material. Simultaneous with translating the tote away from the material, one or more arms of the folding mechanism may at least partially form the cavity. As the arms are actuated to form the cavity, the item(s) become retained within the cavity. In some instances, the arms include a first arm disposed along a first side of the material, for folding in one side of the material, and a second arm disposed along a second side of the material for folding in a second side of the material. The sides of the container, once folded inward, may be sealed together along a top of the container. That is, the sides of the material may be folded inwards to enclose the top of the container. In some instances, enclosing the material in this manner may be referred to as a tube-forming process. These sides of the material that are folded in may represent sections or flaps that are foldable, via the creases, to form the cavity and retain the item(s).

Moreover, the conveyance mechanism includes the pins (e.g., struts, posts, etc.) that bend, move, or fold ends of the container to assist in forming the cavity. In some instances, the pins are actuated simultaneous with translating the tote away from the material and/or one or more arms of the folding mechanism folding in sides of the material. In doing so, the cavity may be formed around the item(s) to prevent the item(s) rolling off the material. In some instances, the conveyance mechanism includes a first pin that translates material at a first end of the container upwards, and a second pin may that translates material at a second end of the container upwards. The material may therefore be folded along multiple sides and ends to form the cavity and to retain the item(s). More specifically, the cavity may be formed at least in part by four sides, where a first of the sides of the cavity is formed via actuation of the first arm, a second of the sides is formed via actuation of the second arm, a third of the sides (e.g., a first end) is formed via actuation of the first pin, and a fourth of the sides (e.g., a second end) is formed via actuation of the second pin.

However, although described as forming a cavity with four sides, for example, more than or less than four sides may be used to form the cavity or other flaps that retain the item(s). For example, the pins of the conveyance mechanism may enclose ends of the cavity, where the ends are located at longitudinal ends of the material transverse to the direction of travel of the material throughout the machine. By enclosing the ends of the material, as compared to the sides, the item(s) may still be retained within the cavity given that the forces imparted to the item(s) via movement of the material are in line with the direction of travel. That is, folding the material at the first end and the second end may provide bulkheads against which the item(s) contact during conveyance throughout the machine. In comparison, the sides may be parallel with the direction of travel, and the forces imparted to the item(s) during movement may not directed towards the sides.

Once the cavity is formed, and the top of the container is sealed together, the conveyance mechanism actuates to move the material onto the sealing mechanism. For example, the first pin and the second pin may be disposed on a rail (e.g., track), and the rail may span between the folding mechanism and the sealing mechanism. Here, as the conveyance mechanism moves, for example, via one or more actuators, the pins drive the container onto the sealing mechanism. For example, the container may be constrained between the first pin and the second pin, and the container may be pushed via engagement between the pin(s) and the container. Moreover, during movement of the container to the sealing mechanism, the first pin and the second pin maintain an engagement with the material to prevent sides of the cavity unfolding and the item(s) to spilling out of the container. That is, being as the first pin and the second pin engage with the material as the container moves to the sealing mechanism, the first pin and the second pin may prevent ends (e.g., the third side and the fourth side) of the cavity unfolding.

The machine may include suction mechanism(s) that suction or otherwise grip the material to prevent the material reorienting as the cavity is formed. For example, given that the material is acted upon to form the cavity, suction mechanism(s) may prevent the material translating upwards as the first arm, the second arm, the first pin, and the second pin act on the material to form the cavity. That is, as the first arm, the second arm, the first pin, and the second pin may be actuated upwards to bend or fold portions of the material, the suction mechanism(s) may prevent unwanted movement of the material as the cavity is formed. In some instances, the suction mechanism(s) may be integrated within the conveyance mechanism. For example, the conveyance mechanism may include a conveyor belt that has holes integrated therein for suctioning to the material.

As the container arrives at the sealing mechanism, the first pin and the second pin may retract (e.g., retreat), and the sealing mechanism may enclose ends of the container. In some instances, the sealing mechanism may include presses that are brought into contact with the material to enclose ends of the container (e.g., adjacent to the third side and the fourth side of the cavity). In some instances, the sealing mechanism includes fingers that actuate inwards, and which hold sides of the material in place while the presses actuate to seal the container. For example, the fingers may actuate to contact the material, while the first pin and the second pin retract, to prevent the ends of the material unfolding. Thereafter, the presses may actuate to seal the cavity. In some instances, the presses move an upper piece of the material into contact with a lower piece of the material, and compresses the material together. In doing so, the upper piece of the material and the lower piece of the material may be secured together.

Once the container is formed, and the item(s) are packaged within the material, the conveyance mechanism may move to engage another piece of material entering the folding mechanism. Therein, the first pin and the second pin of the conveyance mechanism may actuate to fold in ends of the other piece of material, and translate the other piece of material onto the sealing mechanism to form an additional container. The first pin and the second pin may include a variable position along a length of the rail, such that the first pin and the second pin may be positioned according to the size of the container or the cavity to be formed within the material.

In some instances, the creases within the material permit the material to crease, bend, or otherwise fold when the cavity is formed and when the container is sealed. For example, the creases may create sections or flaps that are foldable to create the cavity. As such, the creases, which may represent creases, score lines, perforations, or other features, facilitate bending or other physical manipulation of the material. The location, size, number, and/or orientation of the creases permit formation of the cavity during actuation of the first arm, the second arm, the first pin, the second pin, the fingers, and the presses, respectively. Additionally, the location, size, number, and/or orientation of the creases may be based on the size of the container, and/or the size of the cavity formed within the material. For example, upon arriving at the folding mechanism, the creases may be formed within the material (whether via the machine or a separate machine). In some instances, rollers and/or dies may be used to form any number of different container and/or cavity configurations, including inward-facing gussets, outward-facing gussets, bent sidewalls, round sidewalls, flat sidewalls, and so forth.

In some instances, the creases may include different types of creases, or creases that serve different purposes. Moreover, some of the creases may serve as fold lines in which the material is folded, while other creases may permit the material to be bent, but not folded. For example, a first plurality of the creases may permit the sides of the material to be folded over itself, a second plurality of the creases may permit ends of the material to be bent, or form gussets at the ends, a third plurality of the creases may permit the ends of the material to be bent, and/or a fourth plurality of the creases may permit the ends of the material to be bent. In some instances, the first plurality of the creases are the same as one another, the second plurality of the creases are the same as one another, the third plurality of the creases are the same as one another, and the fourth plurality of the creases may be the same as one another. For example, the first plurality of the creases, the second plurality of the creases, the third plurality of the creases, and the fourth plurality of the creases may individually be the same, but located and/or oriented differently on the packaging material (e.g., along the first side, along the second side, at the first end, at the second end, etc.)

In some instances, the containers may be formed of a single sheet of roll-formed material, such as a paper-based material (e.g., unpadded cardboard, chambered corrugate, single-sided or double-sided corrugate, a non-Gaussian material, etc.). Additionally, the container may take any shape, such as being rectangular, square, cylindrical, and so forth. In some instances, adhesive is applied to the material prior to or at the folding mechanism, and/or at or prior to the sealing mechanism. For example, the adhesive may be used to secure overlapping portions of the material. In addition, the adhesive may be used to secure ends of the material as part of the presses of the sealing mechanism compressing the material.

Although the machine is described as performing certain functions, the machine may additionally or alternatively perform other functions. For example, the machine may apply labels to the containers to ready the containers for shipment. Additionally, the machine may include components used to form the container, such as sensors that measure dimensions of the item(s) being packaged in order to size the container appropriately. Additionally, the machine may operate continuously within the environment to form containers while the material is being conveyed through the machine.

In some instances, the machine may include multiple sets of pins that carry or move the material through the machine. For example, a first set of pins may work in conjunction with a second set of pins. The first set of pins may engage with the material to convey the material along a first length of the machine, and then transfer the material to a second set of pins that convey the material along a second length of the machine. In some instances, the first set of pins may move the material to an end of the folding mechanism, and the second set of pins may engage with the material to pull, exert force, or otherwise push the material through the sealing mechanism. The timing of the exchange between the first set of pins and the second set of pins may be such that the material does not unfold and permit the item(s) to spill out from the cavity. The first set of pins and the second set of pins may be disposed on their respective tracks, rails, etc., and powered via belts, screw drives, and so forth. Additionally, the distance disposed between the pins, whether on a single set of pins or multiple sets of pins, may be variable to account for differently sized containers.

The machine as disclosed herein may secure the item(s) while the material is formed into a container around the item(s). For example, forming the cavity may prevent item(s) rolling off of the material. Conventionally, such item(s) may be at risk of falling off the material (e.g., cylindrical item(s), spherical item(s), unstable item(s), etc.). However, the cavity may be formed to secure these spherically-shaped item(s), cylindrically-shaped item(s), or other unstable item(s) on the material. The item(s) may reside within the cavity while the material is formed around the item(s), thereby encapsulating the item(s) and preventing the item(s) rolling off the material. Additionally, the cavity is prevented from unfolding (e.g., opening) as the material moves between different portions of the machine. The machine may therefore reduce waste and/or packaging material consumption, as well as increase throughput by securing item(s) during packaging.

The present disclosure provides an overall understanding of the principles of the structure, function, device, and system disclosed herein. One or more examples of the present disclosure are illustrated in the accompanying drawings. Those of ordinary skill in the art will understand that the devices and/or the systems specifically described herein and illustrated in the accompanying drawings are non-limiting embodiments. The features illustrated or described in connection with one embodiment may be combined with the features of other embodiments. Such modifications and variations are intended to be included within the scope of the appended claims.

FIG. 1 illustrates an example environment 100 including a machine 102 that functions to form containers for item(s) 104 being processed, according to an example of the present disclosure. In some instances, the environment 100 may represent a facility in which the item(s) are processed, categorized, and/or otherwise readied for shipment. For example, the environment 100 may include an inventory field (not shown) in which items are located. In some instances, robotic elements may be used to pick the item(s) 104 from the inventory field and deliver the item(s) 104 to the machine 102. Additionally, or alternatively, personnel or a combination thereof may be used to pick the item(s) 104. Further, in some instances, conveyor belts and/or other conveyance mechanisms (e.g., rollers, chutes, etc.) may be used to process the item(s) 104 to the machine 102.

The machine 102 includes a plurality of components, stations, or mechanisms for processing the item(s) 104 for shipment. In some instances, the item(s) 104 may arrive at the machine 102 within a tote 106. The tote 106 may include sidewalls 108, a bottom 110, and one or more partitions 112. The tote 106 also includes a compartment 114 in which the item(s) 104 are located. For example, in FIG. 1, three item(s) 104, such as a first item 104(1), a second item 104(2), and a third item 104(3) may reside within the compartment 114. As will be discussed herein, the compartment 114 may be sized according to the item(s) 104 being packaged. The partitions 112 may be moveable such that the size of the compartment 114 adjusts to the space occupied by the item(s) 104. In some instances, the partitions 112 may be moveable multiple directions (e.g., in the X-direction and/or the Z-direction).

Initially, at "1" a portion of packaging material 118 may be cut, formed, or otherwise processed for receiving the item(s) 104. The packaging material 118 may be a roll-formed packaging material, such as corrugate (e.g., chambered corrugate, single sided corrugate, etc.), or a different packaging material, such as a non-Gaussian packaging material, an unpadded packaging material, or the like. In some instances, the packaging material 118 may include any material that may be creased or bent, and which is capable of being formed into a roll 116. Although a single roll of the packaging material 118 is depicted, in some instances, additional rolls of the packaging material 118 may be included. Additionally, different rolls with different widths may provide flexibility in packaging items of different dimensions. The packaging material 118 may be transferred to a conveyor 120 that conveys the packaging material 118 to different components of the machine 102. In some instances, the conveyor 120 may represent a series of conveyors placed end to end (i.e., a first conveyor may transfer the packaging material 118 to a second conveyor, and so forth), or a single conveyor, to convey the packaging material 118 throughout the machine 102. The packaging material 118 travels in a direction of travel 122 through the machine 102.

The packaging material 118 may be cut via a cutting mechanism 124 at "1" which cuts the packaging material 118 according to specifics of the item(s) 104 being packaged. For example, based at least in part on the dimensions of the item(s) 104, a length of the packaging material 118 dispensed from the roll 116 may be determined and the cutting mechanism 124 may sever the packaging material 118 accordingly. The cutting mechanism 124 may also form creases within and/or on the packaging material 118. Details of the creases are discuss herein, however, the creases may assist in forming the packaging material 118 around the item(s) 104. For example, the creases may be creases, score lines, perforations, or other features that facilitate bending of the packaging material 118 into a container formed around the item(s) 104. In some instances, the creases may be embossed, serrated, perforated, texturized, or otherwise deformed on one or more surfaces of the packaging material 118. To form the creases onto/into the packaging material 118, one or more adjustable rollers or dies of the cutting mechanism 124 (or separate from the cutting mechanism 124) may be used. Additional details of forming the creases, or forming a custom container for an item, are discussed in, for example, U.S. patent application Ser. No. 16/871,767, filed May 11, 2020, entitled "Roll-Formed Containers for Shipping," the entirety of which is herein incorporate by reference for all purposes.

Although not shown, the environment 100 or the machine 102 may include one or more cameras or other sensor(s), such as LIDAR sensors, depth sensors, and so forth that determine one or more dimensions of the item(s) 104 (e.g., length, width, height, etc.). For example, the sensor(s) may be used to capture one or more top-down images of the item(s) 104, one or more side-view images of the item(s) 104, and so forth. In some instances, the sensor(s) may determine a size of the compartment 114 of the tote 106 that houses the item(s) 104. For example, the sensor(s) may determine a size of the compartment 114 (e.g., in the X-direction and/or the Z-direction), and this size may be used to form the size of the packaging material 118, the placement of the creases, and so forth. The sensor(s) may generate data that is used to determine one or more dimensions of the item(s) 104.

The packaging material 118 traverses along the conveyor 120 to arrive at a location at which the item(s) 104 are positioned to be transferred from the tote 106 to the packaging material 118. For example, as shown at "2," the tote 106 with the item(s) 104 residing therein may be disposed vertically above the packaging material 118 (e.g., in the Y-direction). In some instances, the tote 106 is moved into position vertically above the packaging material 118 via one or more positioning systems, robotic arms, conveyors, and so forth. Moreover, the compartment 114 of the tote 106 may be centered vertically above the packaging material 118 such that the item(s) 104 are centered on the packaging material 118 when deposited onto the packaging material 118.

In some instances, as the packaging material 118 is fed forward, in the direction of travel 122, an adhesive or sealant, such as a hot melt glue, pressure-sensitive adhesive, tape, glue, thermal sealing component, or other adhesive or sealant may be applied about one or more edges and/or the width of the packaging material 118. For example, in some instances, adhesive may be applied to three sides of the packaging material 118. The adhesive may be absent on a side that comes into contact or is disposed adjacent to the item(s) 104 once the packaging material 118 is folded around the item(s) 104. To apply the adhesive, the adhesive may be sprayed, applied in a beaded or spiral pattern, or otherwise distributed along one or more surfaces of the packaging material 118.

At "3," the bottom 110 of the tote 106 is actuated such that the item(s) 104 fall out of the tote 106 (or the compartment 114) and onto the packaging material 118. As the item(s) 104 are deposited onto the packaging material 118, the tote 106 may reside vertically above the packaging material 118, and the item(s) 104 may be constrained from rolling off the packaging material 118, for example, via an engagement between the item(s) 104 and the sidewalls 108 and/or the partitions 112 of the tote 106. That is, while the item(s) 104 may be resting on the packaging material 118, sides of the item(s) 104 may be in contact with the sidewalls 108 and/or the partitions 112 of the tote 106 to prevent the item(s) 104 rolling off the packaging material 118. As such, the item(s) 104 may be at least partially constrained in place on the packaging material 118.

At "4," a folding mechanism 126 may engage with the packaging material 118 to form a cavity 128 in the packaging material 118. At the same time, or substantially simultaneous with forming the cavity 128, the tote 106 may be advanced upwards (e.g., in the Y-direction). Moving the tote 106, away from the packaging material 118, permits sides of the packaging material 118 to be manipulated inwards to form a container 142 for the item(s) 104. That is, as the tote 106 moves away from the packaging material 118, the folding mechanism 126 folds in sides and/or ends of the packaging material 118 to form the cavity 128. In doing so, the item(s) 104 are constrained within the cavity 128 (e.g., a bowl-like structure) and are prevented from rolling off sides of the packaging material 118 and/or ends of the packaging material 118. In some instances, the tote 106 is moved away from the packaging material 118 via a robotic arm, conveyor, and so forth.

As will be explained herein, the folding mechanism 126 may include arms that engage with sides of the packaging material 118, such as along a first side 130 and a second side 132. A first arm may engage with the packaging material 118 along the first side 130, while a second arm may engage with the packaging material 118 along the second side 132. As the first side 130 and the second side 132 are advanced upwards (e.g., in the Y-direction), for example, the cavity 128 becomes enclosed along two lateral sides (e.g., spaced apart in the X-direction). These lateral sides may be parallel to the direction of travel 122.

Moreover, as will also be explained herein, the machine 102 may also include a conveyance mechanism 134 having one or more pins that engage with portions of the packaging material 118 in order to form the cavity 128. For example, a first pin may engage with the packaging material 118 at a first end 136 of the packaging material 118, and a second pin may engage with the packaging material 118 at a second end 138 of the packaging material 118. As the first end 136 and the second end 138 are advanced upwards (e.g., in the Y-direction), for example, the cavity 128 becomes walled along two longitudinal ends (e.g., spaced apart in the Z-direction). These two longitudinal ends may be transverse to the direction of travel 122. The first end 136 may be a leading end (relative to the direction of travel 122), while the second end 138 may be a trailing end and spaced apart from the leading end (e.g., in the Z-direction). Accordingly, the cavity 128 may be enclosed (or partially enclosed) along for sides via the folding mechanism 126 and/or the conveyance mechanism 134 in order to prevent the item(s) 104 being displaced from within the cavity 128.

After the cavity 128 is formed, at "5" the folding mechanism 126 may at least partially form the container 142 (via the packaging material 118) around the item(s) 104 (e.g., tube-like structure). For example, the arms of the folding mechanism 126 may fold the first side 130 of the packaging material 118 over the item(s) 104, and the second side 132 of the packaging material 118 over the first side 130 of the packaging material 118. This folding creates an overlap between the first side 130 and the second side 132. The folding mechanism 126 may also include one or more folding bars that are used to press the first side 130 and the second side 132 into contact to seal the container 142. For example, after the first side 130 and the second side 132 are folded, the first side 130 and the second side 132 may be pressed to cause the adhesive to bind the overlap together to form a seal along a top of the container 142, for example. Additionally, or alternatively, the folding bars may be used to form inward-facing or outward-facing gussets along sides of the container 142, or to form sides of the container 142.

Additionally, at "5" as the folding mechanism 126 folds the first side 130 and the second side 132 of the packaging material 118, the pins of the conveyance mechanism 134 may continue to hold the first end 136 and the second end 138 of the packaging material 118 to enclose the ends of the cavity 128. As such, while the sides of the container 142 are being formed, for example, the pins of the conveyance mechanism 134 help form the cavity 128 to retain the item(s) 104 within the cavity 128. During movement of the container 142 through the machine 102, the pins of the conveyance mechanism 134 may maintain an engagement with the packaging material 118 to prevent the first end 136 and the second end 138 of the packaging material 118 unfolding. The conveyance mechanism 134 may therefore move with the packaging material 118 and/or the container 142, along the conveyor 120, as the cavity 128 is enclosed.

At "6" the packaging material 118 may then arrive at a sealing mechanism 140 that functions to enclose the packaging material 118 at longitudinal ends of the container 142. More specifically, the sealing mechanism 140 serves to enclose longitudinal ends of the container 142 to enclose the item(s) 104 at the first end 136 and the second end 138. As will be explained herein, in some instances, the sealing mechanism 140 includes presses that compress the packaging material 118 at the first end 136 and the second end 138. A first press may press the packaging material 118 together at the first end 136, while a second press may press the packaging material 118 together at the second end 138.

In some instances, the sealing mechanism 140 includes fingers that actuate inwards, and which hold packaging material 118 at the first end 136 and the second end 138 in place while the presses actuate to seal the container 142. For example, the fingers may actuate to contact the packaging material 118, while the first pin and the second pin retract, to prevent the first end 136 and the second end 138 of the packaging material 118 unfolding. Thereafter, the presses may actuate to seal the cavity 128.

Finally, at "7" the item(s) 104 may be packaged and the container 142, formed from the packaging material 118, may enclose the item(s) 104. After formation of the container 142, the container 142 may be further processed within the environment 100, or another environment. For example, the container 142 may be sorted for shipment to a final destination.

Although the machine 102 is shown including certain components, or stations, for forming the container 142, the machine 102 (or the environment 100) may include additional or alternative components. Moreover, the machine 102 may be configured to form various sized containers having different widths, lengths, and/or heights. In such instances, however, the cavity 128 is formed within the packaging material 118 for retaining the item(s) 104 therein. Additionally, although three item(s) 104 are shown being packaged within container 142, more than or less than three item(s) 104 may be packaged in the packaging material 118. The item(s) 104 packaged may be different than those as shown (e.g., shape, size, etc.).

Although a single machine is discussed, it is to be understood that the environment 100 may include any number of machines that process the item(s) 104 for shipment. Any number of the machines are configured to operate independently and perform operations for processing the item(s) 104 for shipment. In some instances, the machine 102 may couple to remote computing resource(s) that may, in some instances, control at least part of the operation of the machine 102 (e.g., determining dimensions of the item(s) 104).

Figure 2:
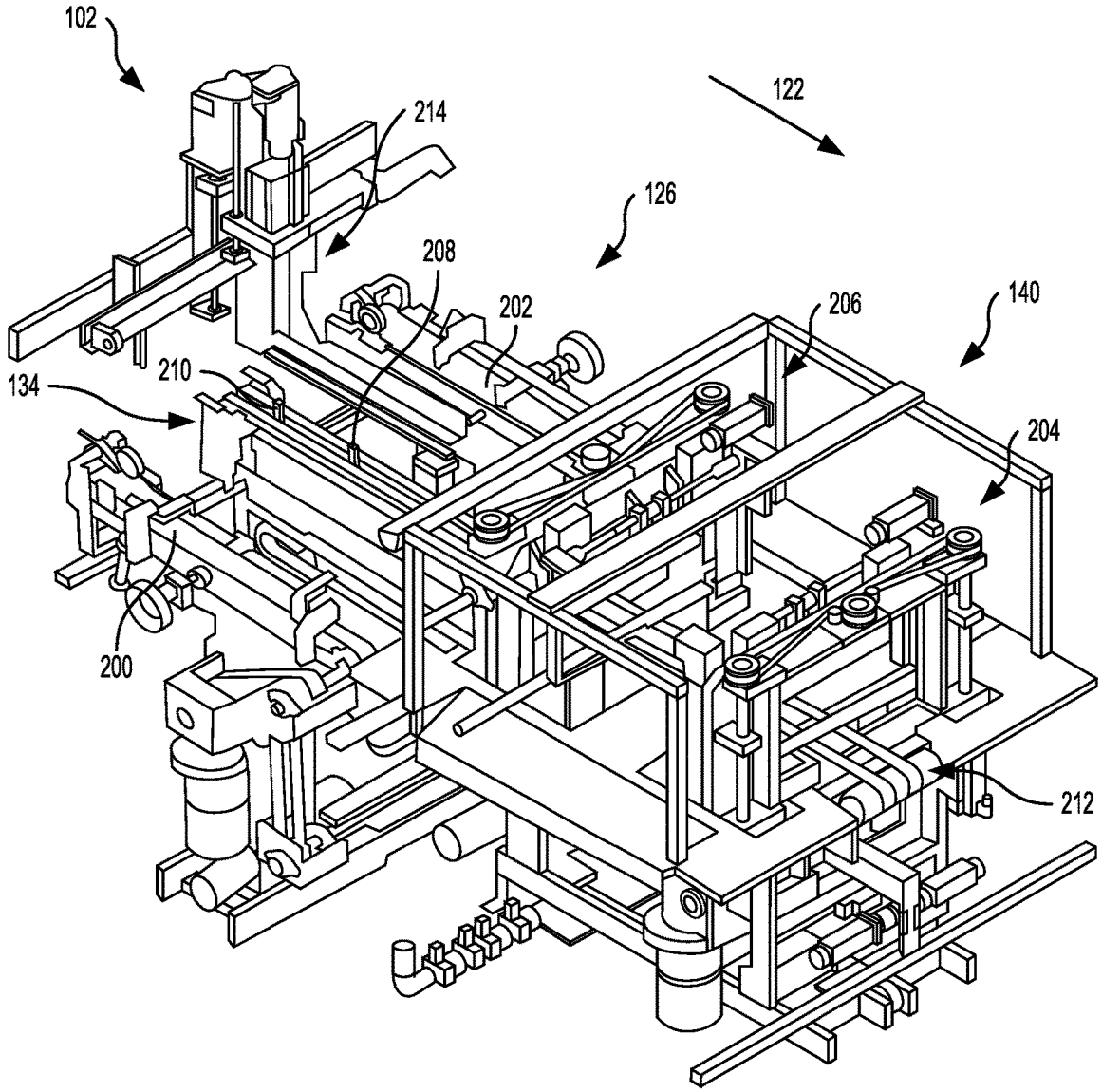
FIG. 2 illustrates a perspective view of a portion of the machine of FIG. 1, according to examples of the present disclosure.
Figure 2:
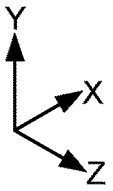

FIG. 2 illustrates example components of the machine 102, according to examples of the present disclosure. In some instances, the view shown in FIG. 2 includes the folding mechanism 126, the conveyance mechanism 134, and the sealing mechanism 140. The folding mechanism 126 may reside prior to the sealing mechanism 140 (e.g., relative to the direction of travel 122), and in some instances the conveyance mechanism 134 may span between the folding mechanism 126 and the sealing mechanism 140.

The folding mechanism 126 may include at least a first arm 200 and a second arm 202. The first arm 200 may be disposed adjacent to the first side 130 of the packaging material 118, and the second arm 202 may be disposed adjacent to the second side 132 of the packaging material 118. In some instances, as the packaging material 118 arrives at the folding mechanism 126, the first side 130 may rest on the first arm 200, and the second side 132 may rest on the second arm 202. However, to fold in the first side 130 and the second side 132 of the packaging material 118, inwards towards the item(s) 104 being packaged, the first arm 200 and/or the second arm 202 may translate in a vertical and/or horizontal direction. For example, the first arm 200 may vertically translate (e.g., in the Y-direction) to fold the first side 130 upwards, and may then horizontally translate (e.g., in the X-direction) to fold the first side 130 over the item(s) 104. Similarly, in some instances, after the first side 130 is folded, the second arm 202 may vertically translate (e.g., in the Y-direction) to fold the second side 132 upwards, and may then horizontally translate (e.g., in the X-direction) to fold the second side 132 over the item(s) 104 (and/or the first side 130).

The sealing mechanism 140 may include at least a first press 204 and a second press 206. The first press 204 seals the packaging material 118 together at the first end 136, while the second press 206 seals the packaging material 118 together at the second end 138. For example, the first press 204 and the second press 206 may vertically actuate (e.g., in the Y-direction) to seal the packaging material 118 and form the container 142.

The conveyance mechanism 134 includes pins that act on the packaging material 118 to form the cavity 128 and/or the container 142. The pins, as will be discussed herein, translate between the folding mechanism 126 and the sealing mechanism 140 to prevent the packaging material 118 unfolding prior to the container 142 being formed. In some instances, the pins include a first pin 208 and a second pin 210. The first pin 208 may engage with the first end 136 of the packaging material 118, while the second pin 210 may engage with the second end 138 of the packaging material 118.

In some instances, the folding mechanism 126 may also include one or more folding bar(s) 214. In some instances, the folding bar(s) 214 serve to adhere the first side 130 and the second side 132 to one another, over a top of the item(s) 104. For example, a first of the folding bar(s) 214 may be disposed above item(s) 104, inside the cavity 128, while a second of the folding bar(s) 214 may be disposed outside the cavity 128. The second of the folding bar(s) 214, however, may be pressed into the first of the folding bar(s) 214 to secure the first side 130 and the second side 132 of the packaging material 118 to one another. In doing so, the first of the folding bar(s) 214 may prevent damage to the item(s) 104 and the container 142 may be enclosed along a top. The machine 102 may have central conveyors 212 that translate the packaging material 118 through the sealing mechanism 140.

Figure 3A:
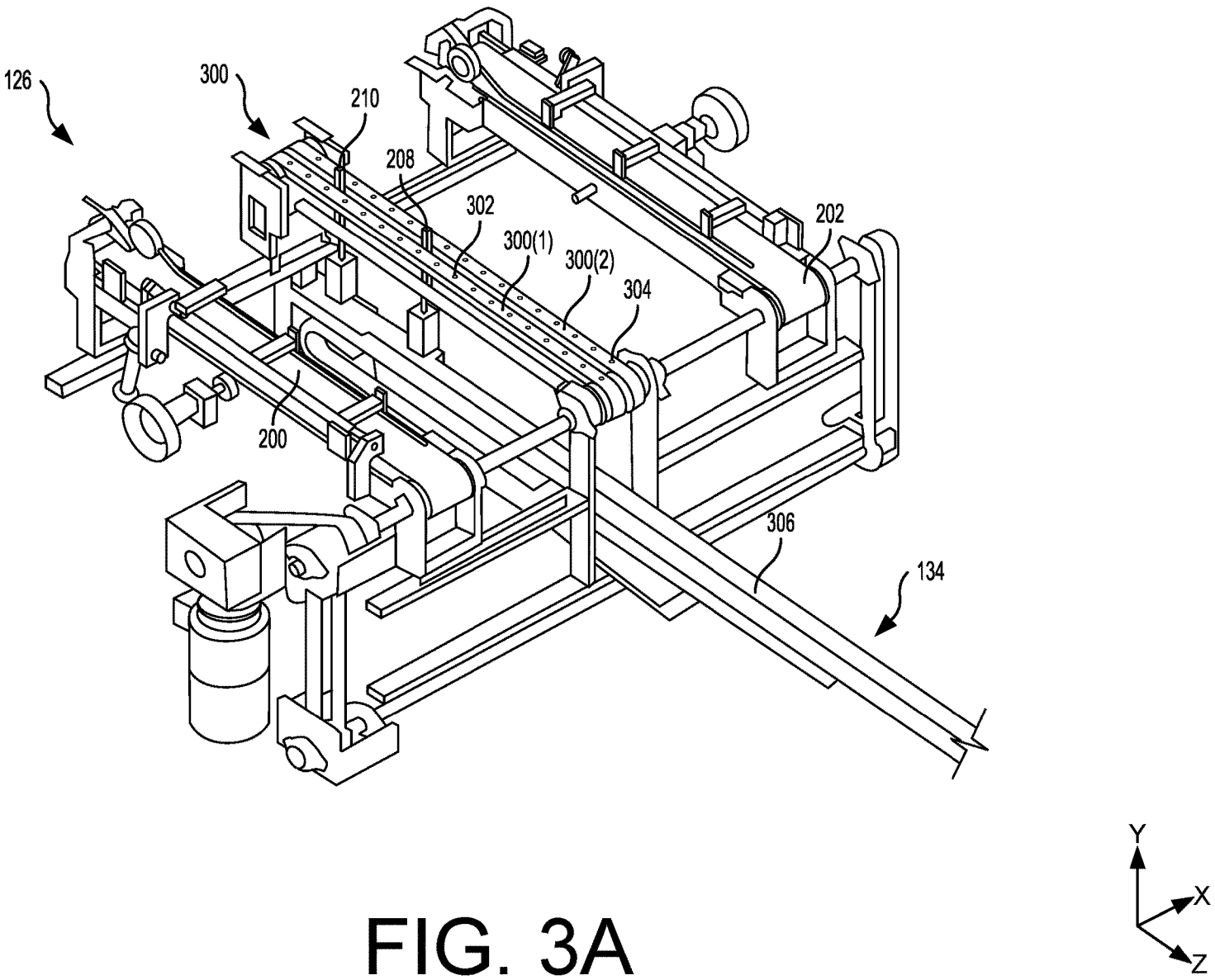
FIGS. 3A and 3B illustrate the folding mechanism and an example conveyance mechanism of the machine of FIG. 1, according to examples of the present disclosure.
Figure 3B:
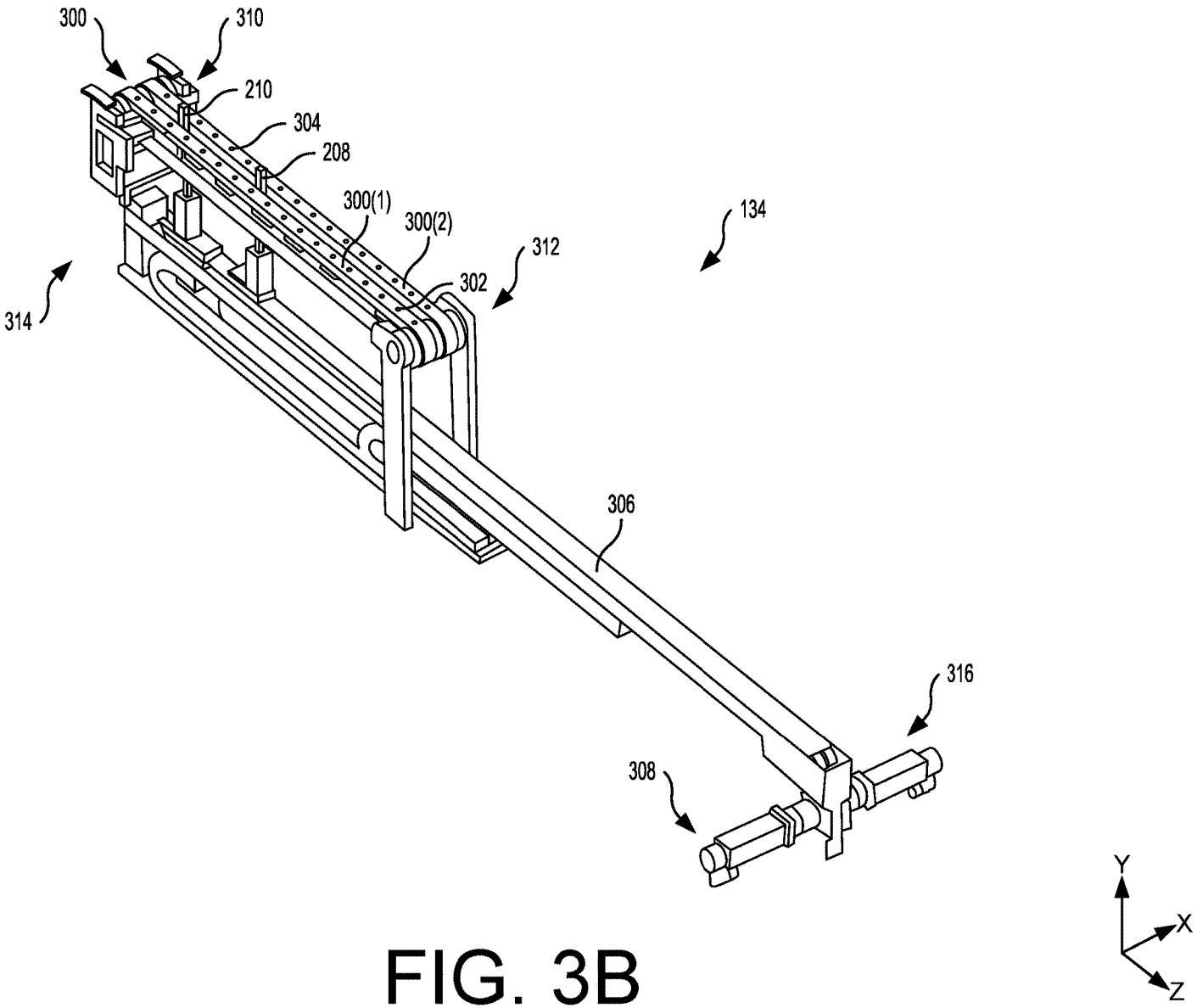

FIGS. 3A and 3B illustrate portions of the folding mechanism 126 and the conveyance mechanism 134, according to examples of the present disclosure.

The conveyance mechanism 134 includes central conveyors 300, which represent belts that may drive the packaging material 118. The central conveyors 300 include holes that are in fluid connection with a vacuum, for example, to suction to the packaging material 118. For example, a first central conveyor 300(1) may include first holes 302, and a second central conveyor 300(2) may include second holes 304. As the packaging material 118 comes into contact with the central conveyors 300, the packaging material 118 is suctioned to maintain an orientation of the packaging material 118 as the container 142 is formed. For example, given that the packaging material 118 is acted upon to form the cavity 128, the suction mechanism(s) may prevent the packaging material 118 translating upwards as the first arm 200, the second arm 202, the first pin 208, and the second pin 210 act on the packaging material 118 to form the cavity 128. That is, as the first arm 200, the second arm 202, the first pin 208, and the second pin 210 may be actuated upwards to bend or fold portions of the packaging material 118, the suction mechanism(s) may prevent unwanted movement of the packaging material 118 as the cavity 128 is formed.

The conveyance mechanism 134 includes a rail 306 along which the first pin 208 and the second pin 210 are coupled. The first pin 208 and the second pin 210 may be driven along the rail 306, for example, via one or more actuators 308. For example, as the first pin 208 and the second pin 210 engage with the packaging material 118, the actuators 308 may drive the first pin 208 and the second pin 210 along the rail 306 in order to move the packaging material 118 (or the container 142) from the folding mechanism 126 to the sealing mechanism 140. In some instances, the first pin 208 and the second pin 210 extend from cylinders that couple to the rail 306.

The first pin 208 and the second pin 210 are shown in an extended position in which the first pin 208 and the second pin 210 engage with the packaging material 118. In the extended position, the first pin 208 and the second pin 210 extend vertically above the central conveyors 300. However, the first pin 208 and the second pin 210 are configured to retract, vertically below the central conveyors 300 (e.g., into the cylinders). For example, the first pin 208 and the second pin 210 may extend to engage the packaging material 118 and form the container 142, but may retract when the packaging material 118 is first being loaded onto the central conveyors 300.

A distance between the first pin 208 and the second pin 210 may be adjustable depending upon the size of the container 142 to be formed. For example, a distance between the first pin 208 and the second pin 210 may be variably set based up the size of the container 142. In some instances, the conveyance mechanism 134 may be instructed to move the first pin 208 and/or the second pin 210 to different locations along the rail 306 based upon the size of the container 142. Once in position, the first pin 208 and the second pin 210 may be secured (e.g., temporarily locked in place), such that the first pin 208 and the second pin 210 may translate along the rail 306 to move the container 142 to the sealing mechanism 140.

In some instances, the first pin 208 and the second pin 210 are interposed between the central conveyors 300. The central conveyors 300 may route around a first pulley 310 and a second pulley 312. In some instances, the first pin 208 and the second pin 210 are configured to momentarily move to the retracted position in order to pass underneath the second pulley 312. For example, as the first pin 208 and the second pin 210 move from a first end 314 to a second end 316 of the rail 306, the first pin 208 and the second pin 210 may retract under the second pulley 312 and the extend to engage the packaging material 118. Therein, the first pin 208 and the second pin 210 may route through the central conveyors 212 of the sealing mechanism 140 for moving the packaging material 118 through the sealing mechanism 140. After the conveyance mechanism 134 conveys the container 142 to the sealing mechanism 140, and the sealing mechanism 140 seals the container 142, the first pin 208 and the second pin 210 may move back towards the first end 314 to engage with another piece of the packaging material 118.

However, in some instances, the first pin 208 and the second pin 210 may be configured to hand off the packaging material 118 to other pins associated with the sealing mechanism 140. For example, the first pin 208 and the second pin 210 may be considered a first set of pins, and the packaging material 118 may be handed off to a second set of pins at the sealing mechanism 140. The second set of pins may engage with the packaging material 118, at the first end 136 and the second end 138, as the first set of pins disengage the packaging material 118. For example, as the first set of pins move the packaging material 118 to an end of the folding mechanism 126, adjacent to the second pulley 312, the second set of pins may engage with the packaging material 118 to pull or otherwise push the packaging material 118 through the sealing mechanism 140. In these instances, the first set of pins may not be required to retreat in order to pass underneath the second pulley 312. The timing of the exchange between the first set of pins and the second set of pins may be such that the packaging material 118 does not unfold to permit the item(s) 104 to spill out from the cavity 128. The first set of pins and the second set of pins may be disposed on their respective tracks, rails, etc., and powered via belts, screw drives, and so forth.

Figure 4A:
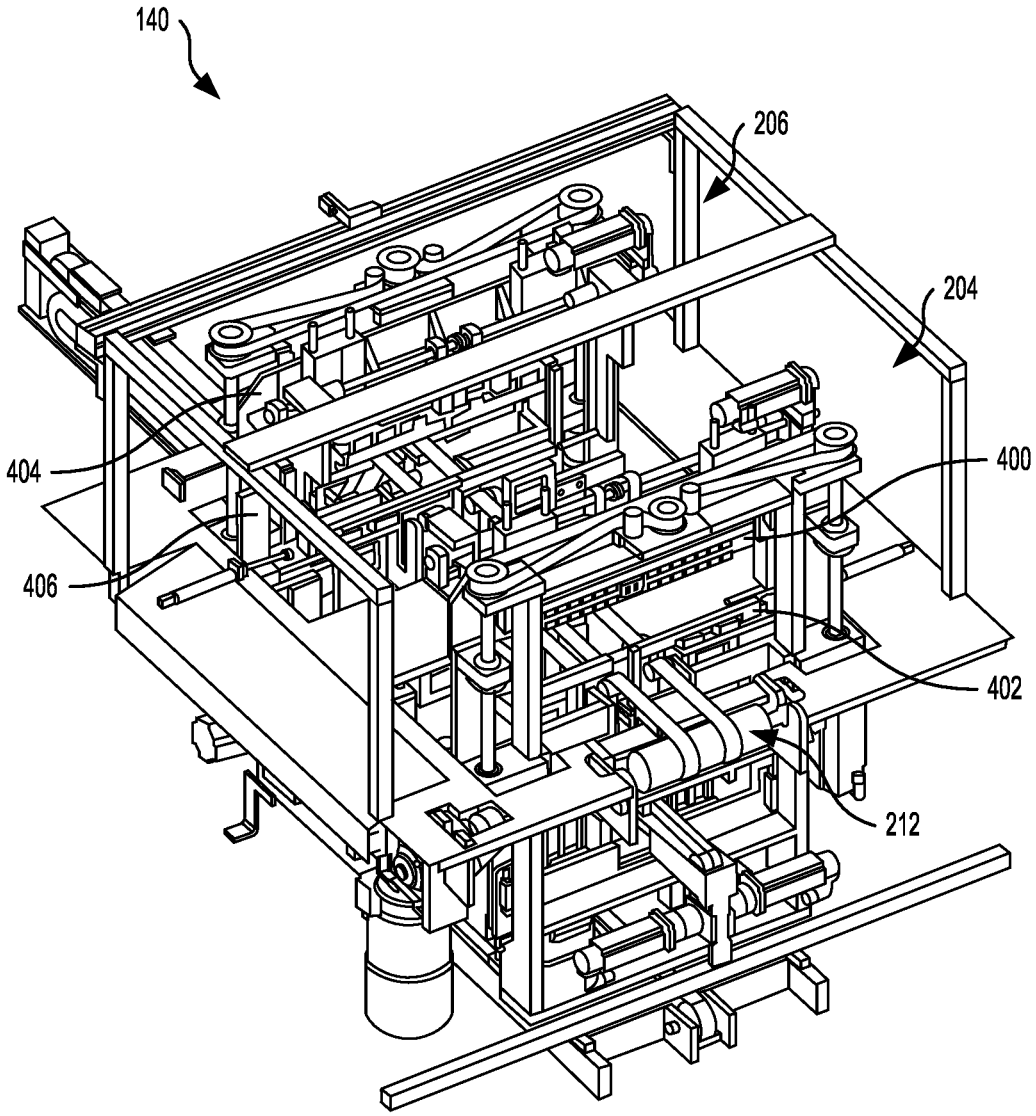
FIGS. 4A and 4B illustrate the sealing mechanism of the machine of FIG. 1, according to examples of the present disclosure.
Figure 4A:
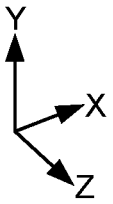
Figure 4B:
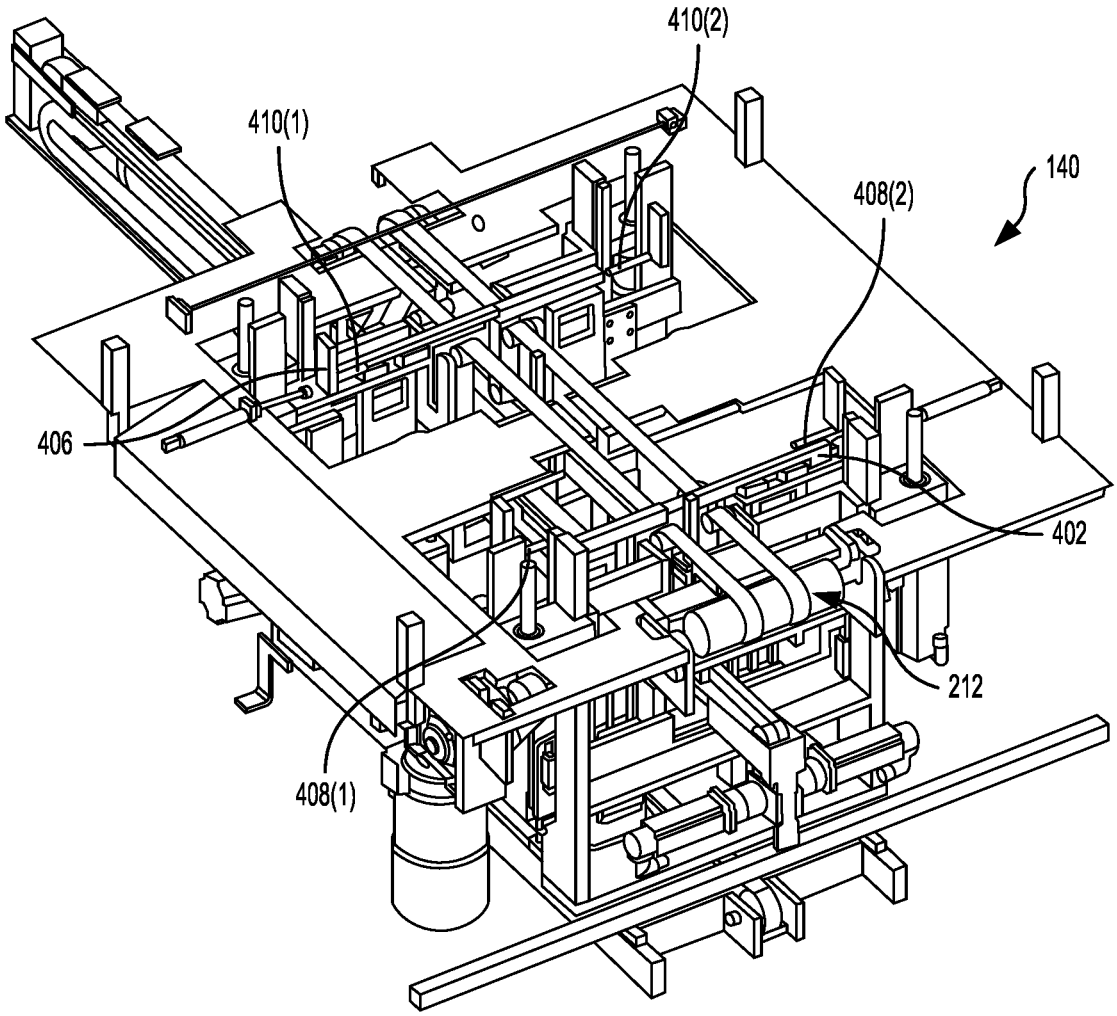
Figure 4B:
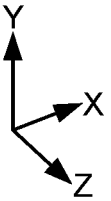

FIGS. 4A and 4B illustrate the sealing mechanism 140, according to examples of the present disclosure. The sealing mechanism 140 includes the first press 204 and the second press 206. The first press 204 is configured to seal the first end 136 of the packaging material 118, and the second press 206 is configured to seal the second end 138 of the packaging material 118.

In some instances, the first press 204 includes a first upper press 400 and a first lower press 402. The first upper press 400 may be disposed vertically above the packaging material 118, and the first lower press 402 may be disposed vertically below the packaging material 118. The first upper press 400 and the first lower press 402 may be brought together (e.g., in the Y-direction) to seal the packaging material 118 together at the first end 136. In some instances, the first lower press 402 is composed of two separate members that are spaced apart in the X-direction. The spacing between the members of the first lower press 402 permit the first pin 208 to traverse therebetween. Once the first pin 208 moves between the members of the first lower press 402, the members of the first lower press 402 may be brought together (e.g., in the X-direction). From there, the first upper press lower press 400 and the first lower press 402 may be actuated in the vertical direction to seal the first end 136 of the container 128.

In some instances, the second press 206 includes a second upper press 404 and a second lower press 406. The second upper press 404 may be disposed vertically above the packaging material 118, and the second lower press 406 may be disposed vertically below the packaging material 118. The second upper press 404 and the second lower press 406 may be brought together (e.g., in the Y-direction) to seal the packaging material 118 together at the second end 138.

In some instances, the distance interposed between the first press 204 and the second press 206 may be adjustable depending upon the size of the container 142 to be formed. For example, for a longer container, the first press 204 and the second press 206 may be spaced farther apart (e.g., in the Z-direction), and for a shorter container, the first press 204 and the second press 206 may be spaced closer together (e.g., in the Z-direction).

The central conveyors 212 route the packaging material 118 through the sealing mechanism 140 as the sealing mechanism 140 seals the packaging material 118. The first pin 208 and the second pin 210 of the conveyance mechanism 134, for example, may move the packaging material 118 through the sealing mechanism 140, along the central conveyors 212. In some instances, however, and as noted above, other pins may be disposed between the central conveyors 212 for moving the packaging material 118 through the sealing mechanism 140.

In some instances, the sealing mechanism 140 includes fingers that actuate inwards, towards the packaging material 118 (e.g., in X-direction), and which hold sides and/or ends of the packaging material 118 in place while the first press 204 and the second press 206 actuate to seal the container 142. For example, the fingers may actuate to contact the packaging material 118, while the first pin 208 and the second pin 210 retract (e.g., beneath the central conveyors 212), to prevent the first end 136 and the second end 138 of the packaging material 118 unfolding. Thereafter, the first press 204 and the second press 206 may actuate to seal the container 142. Accordingly, fingers may hold the first end 136 and the second end 138 of the packaging material 118, while the first pin 208 and the second pin 210 move out of the way and while the first press 204 and the second press 206 seal ends of the container 142. In some instances, the fingers include first fingers 408(1) and 408(2) that engage with the packaging material 118 at the first end 136, and second fingers 410(1) and 410(2) that engage with the packaging material 118 at the second end 138. The first fingers 408(1) and 408(2), and the second fingers 410(1) and 410(2) may move between retracted and extended positions.

FIGS. 5A-5E illustrate example creases 500 of the packaging material 118 for forming the cavity 128 for the item(s) 104 and the container 142 around the item(s) 104, according to examples of the present disclosure. In some instances, the creases 500 are formed via the cutting mechanism 124. For example, the cutting mechanism 124 may have roller or dies that form creases 500 in the packaging material 118. Additionally, in FIGS. 5A-5E, portion of the packaging material 118 are shown being folded or semi-folded.

The creases 500 may include a first crease 500(1), a second crease 500(2), a third crease 500(3), and a fourth crease 500(4). The creases 500(1)-(4) may extend along a length of the packaging material 118 (e.g., in the Z-direction), between the first end 136 and the second end 138. The creases 500(1)-(4) may be parallel to the direction of travel 122 of the packaging material 118 through the machine 102. In some instances, the creases 500(1)-(4) permit the first side 130 and the second side 132 of the packaging material 118 to fold upwards in response to the first arm 200 and the second arm 202 contacting the packaging material 118. In this sense, the creases 500(1)-(4) may be considered fold lines that permit the packaging material 118 to be folded itself to fore a tube-like structure. For example, the packaging material 118 may bend at the first crease 500(1) and the second crease 500(2) to fold the first side 130 over the cavity 128, and the packaging material 118 may bend at the third crease 500(3) and the fourth crease 500(4) to fold the second side 132 over the cavity 128. In some instances, the creases 500(1)-(4) may be formed on a top surface of the packaging material 118, opposite a bottom surface that is engaged by the first arm 200, the second arm 202, the first pin 208, and the second pin 210.

A first section 502 of the packaging material 118 and a second section 504 of the packaging material 118 may at least partially form the cavity 128. For example, as the first arm 200 engages with the first side 130 (e.g., the bottom surface along the first side 130), the first section 502 may fold upwards about the second crease 500(2) (e.g., about the Z-axis). Additionally, as the first arm 200 continues to advance upwards to fold the packaging material 118, the packaging material 118 may fold about the first crease 500(1) to dispose the first side 130 over the top of the cavity 128. As the second arm 202 engages with the second side 132 (e.g., the bottom surface along the second side 132), the second section 504 may fold upwards about the third crease 500(3) (e.g., about the Z-axis). Additionally, as the second arm 202 continues to advance upwards to fold the packaging material 118, the packaging material 118 may fold about the fourth crease 500(4) to dispose the second side 132 over the top of the cavity 128, or over the first side 130. Arrows are shown to indicate the fold direction of the packaging material 118 as the first arm 200 and the second arm 202 are actuated to fold the first section 502 and the second section 504 of the packaging material 118 and form the cavity 128.

In some instances, a height of the first section 502 and/or the second section 504 (e.g., in the Y-direction) may be based at least in part on a size of the container 142 to be formed. For example, the distance between the first crease 500(1) and the second crease 500(2) may be varied (e.g., in the X-direction), so as to form a container with shorter or higher walls. In doing so, the cavity 128 may have a variable height depending upon the size of the item(s) 104 to be placed therein. Portions of the cutting mechanism 124 that form the first crease 500(1) and the second crease 500(2) may be movable to as to space the first crease 500(1) and the second crease 500(2) closer to one another other (e.g., for smaller items) or farther apart from one another (e.g., for larger items). The portions of the cutting mechanism 124 that form the third crease 500(3) and the fourth crease 500(4) may similarly be adjusted.

The creases 500 may further include a fifth crease 500(5), a sixth crease 500(6), a seventh crease 500(7), and an eighth crease 500(8). The fifth crease 500(5) and the sixth crease 500(6) may extend from the first end 136 of the packaging material 118. The seventh crease 500(7) and the eighth crease 500(8) may extend from the second end 138 of the packaging material 118. The creases 500(5)-(8) may assist in folding in the first end 136 and the second end 138 of the packaging material 118. For example, the creases 500(5)-(8) may form gussets along the first side 130 and/or the second side 132 as the container 142 is formed and to permit the packaging material 118 to be folded over itself.

Generally, the creases 500(5)-(8) include a "Y" shape. Discussion herein is with regard to the fifth crease 500(5) in FIG. 5E, however, the creases 500(6)-(8) may include similar components. In some instances, the fifth crease 500(5) may include three segments, such as a first segment 506(1), a second segment 506(2), and a third segment 506(3). The first segment 506(1) may extend from the first end 136 (e.g., an edge thereof), inward toward the packaging material 118 or towards the second end 138. In some instances, the first segment 506(1) is spaced between the first crease 500(1) and the second crease 500(2). In some instances, the first segment 506(1) may be parallel to the first crease 500(1) and/or the second crease 500(2). As such, in some instances, the first segment 506(1) may be parallel with the direction of travel 122.

The second segment 506(2) and the third segment 506(3) extend from an end of the first segment 506(1), spaced apart from the first end 136 of the packaging material 118. In some instances, the second segment 506(2) and the third segment 506(3) are disposed at 90 degrees relative to one another. In some instances, the second segment 506(2) is disposed at 135 degrees relative to the first segment 506(1) and/or the third segment 506(3) is disposed at 135 degrees relative to the first segment 506(1). The second segment 506(2) may extend in a first direction away from the first segment 506(1) (e.g., towards the first side 130 and/or the second end 138), and/or the third segment 506(3) may extend in a second direction away from the first segment 506(1) (e.g., towards the second side 132 and/or the second end 138). As shown, the second segment 506(2) may intersect (e.g., crossover, traverse over, etc.) the first crease 500(1). The third segment 506(3) may intersect (e.g., crossover, traverse over, etc.) the second crease 500(2). In some instances, the first segment 506(1) is shorter in length than the second segment 506(2) and/or the third segment 506(3). In some instances, the second segment 506(2) and the third segment 506(3) are equal in length.

The creases 500 further include a nineth crease 500(9), a tenth crease 500(10), an eleventh crease 500(11), a twelfth crease 500(12), a thirteenth crease 500(13), a fourteenth crease 500(14), a fifteenth crease 500(15), and a sixteenth crease 500(16). The creases 500(9)-(16) assist in folding the first end 136 and/or the second end 138 of the packaging material 118, respectively, to form the cavity 128 for the item(s) 104. For example, the creases 500(9)-(12) may permit the first end 136 of the packaging material 118 to fold inwards, when acted upon by the first pin 208. The creases 500(13)-(16) may permit the second end 138 of the packaging material 118 to fold inwards, when acted upon by the second pin 210. Arrows are shown to indicate the fold direction of the packaging material 118 as the first pin 208 and the second pin 210 are actuated to fold the first end 136 and the second end 138 of the packaging material 118. In some instances, the packaging material 118 may only include one of the nineth crease 500(9) or the tenth crease 500(10), one of the eleventh crease 500(11) or the twelfth crease 500(12), one of the thirteenth crease 500(13) or the fourteenth crease 500(14), and one of the fifteenth crease 500(15) or the sixteenth crease 500(16). In some instances, the number of creases 500(9)-(16) may be based at least in part on a size of the container 128 to be formed.

Once folded, in addition to the first section 502 and the second section 504, the cavity 128 may be enclosed by a third section 508 and a fourth section 510. That is, the first section 502, the second section 504, the third section 508, and the fourth section 510 may form sidewalls, barriers, etc. of the cavity 128 to retain the item(s) 104. As such, the first section 502, the second section 504, the third section 508, and the fourth section 510 may be flaps that are folded upwards to at least partially enclose the cavity 128.

The nineth crease 500(9) and the tenth crease 500(10) may be connected to or extend from the third segment 506(3) of the fifth crease 500(5). The eleventh crease 500(11) and the twelfth crease 500(12) may be connected to or extend from the sixth crease 500(6) (e.g., a segment thereof). In some instances, the nineth crease 500(9) and the tenth crease 500(10) extend from the first end 136 to the fifth crease 500(5), and the eleventh crease 500(11) and the twelfth crease 500(12) extend from the first end 136 to the sixth crease 500(6).

The thirteenth crease 500(13) and the fourteenth crease 500(14) may be connected to or extend from the seventh crease 500(7) (e.g., a segment thereof). The fifteenth crease 500(15) and the sixteenth crease 500(16) may be connected to or extend from the eighth crease 500(8) (e.g., a segment thereof). In some instances, the thirteenth crease 500(13) and the fourteenth crease 500(14) extend from the second end 138 to the seventh crease 500(7), and the fifteenth crease 500(15) and the sixteenth crease 500(16) may extend from the second end 138 to the eighth crease 500(8).

Figure 5A:
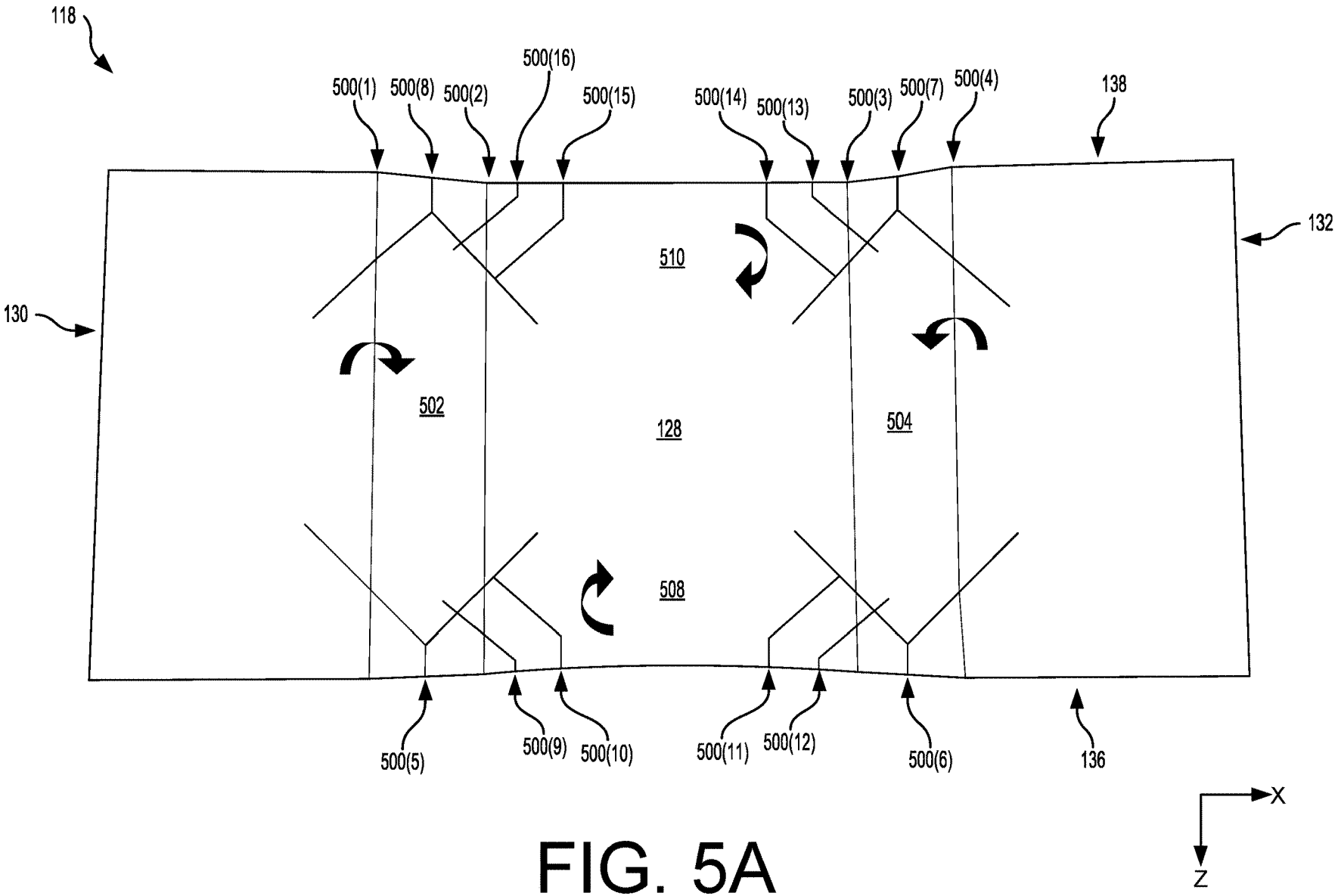
FIGS. 5A-5E illustrate example creases of an example container constructed at least in part by the machine of FIG. 1, according to examples of the present disclosure.
Figure 5B:
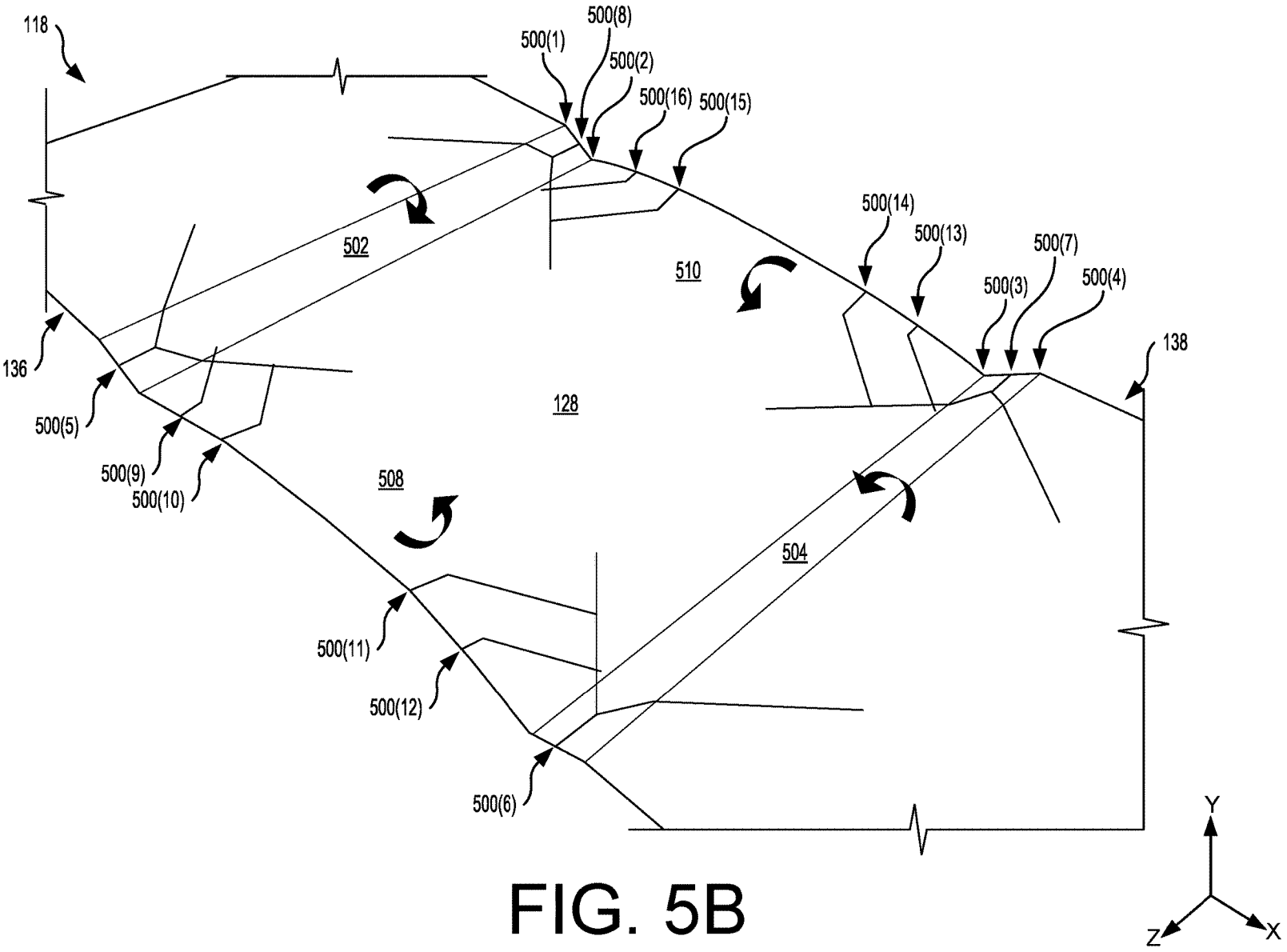
Figure 5C:
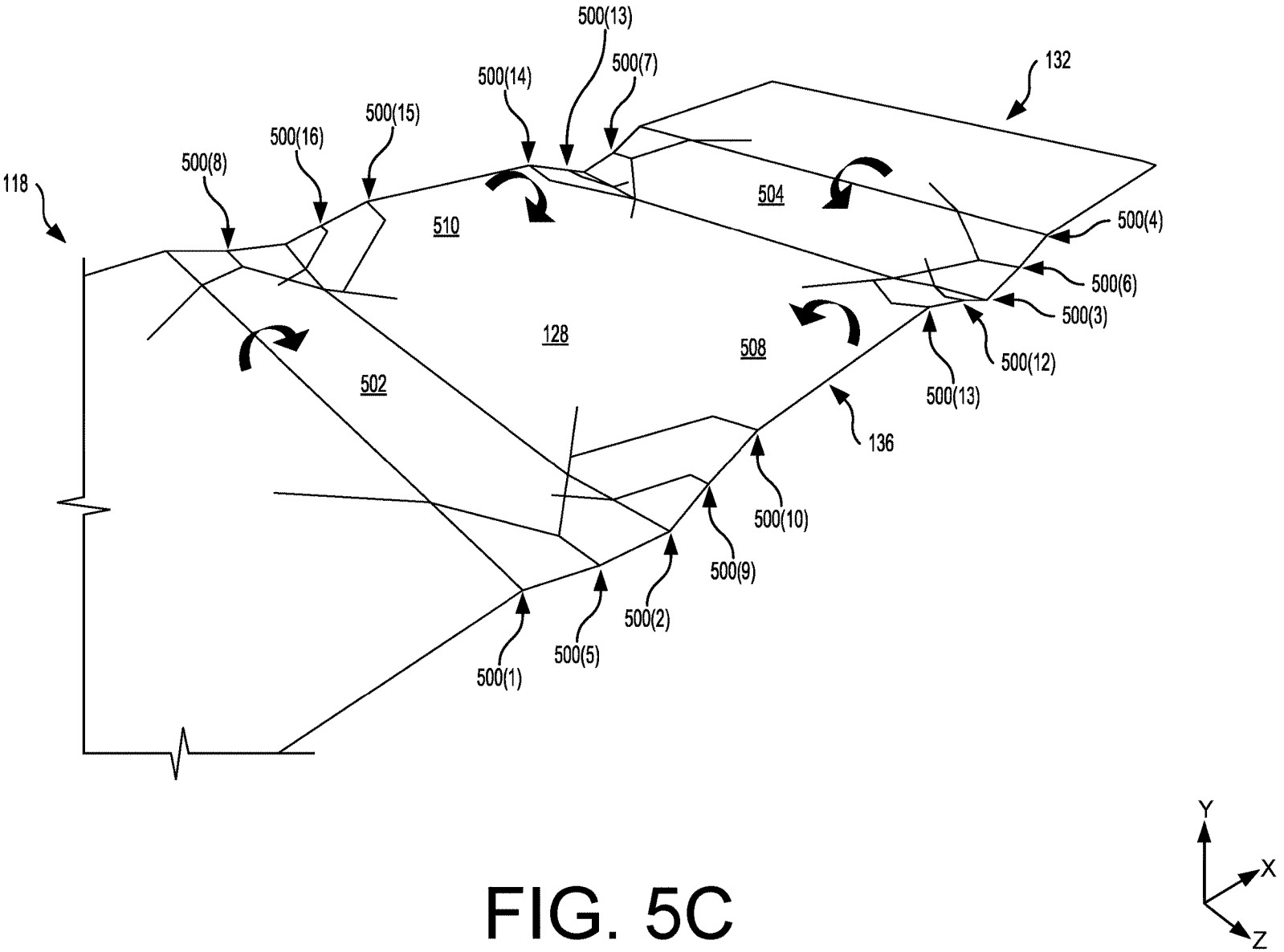
Figure 5D:
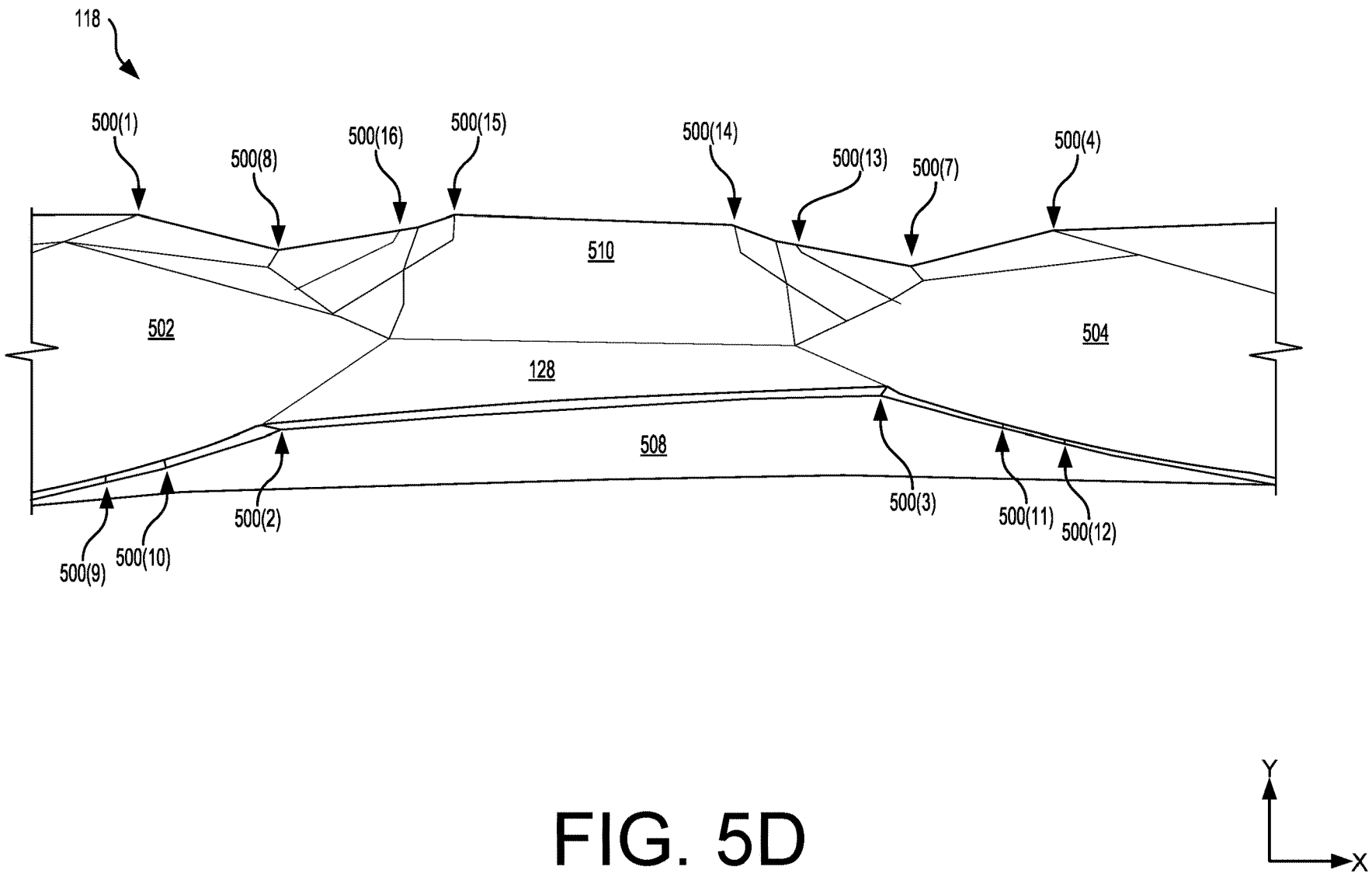
Figure 5E:
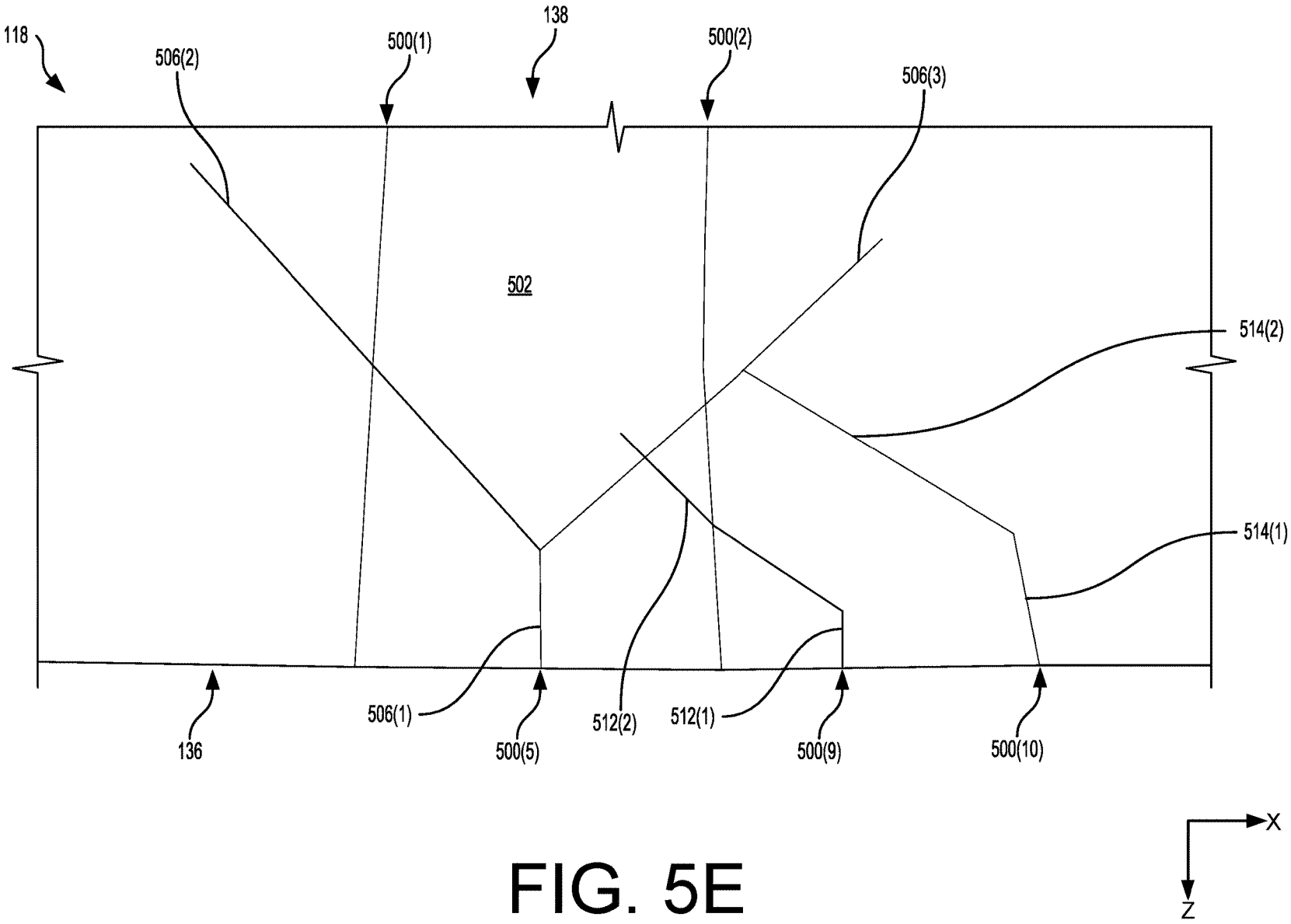

A detailed explanation of the creases 500(9)-(16) is discussed in relation to FIG. 5E. In FIG. 5E, the nineth crease 500(9) and the tenth crease 500(10) are shown and discussed herein, however, the creases 500(11)-(16) may include similar components. In some instances, the nineth crease 500(9) includes a two segments, such as a first segment 512(1) and a second segment 512(2). The first segment 512(1) may extend from the first end 136, in a direction towards the second end 138 (e.g., in the Z-direction). The first segment 512(1) may be parallel to the first crease 500(1), the second crease 500(2), and/or the first segment 506(1) of the fifth crease 500(5). The second segment 512(2) may extend from the first segment 512(1). In some instances, the second segment 512(2) is disposed at 135 degrees relative to the first segment 512(1). Additionally, or alternatively, the second segment 512(2) may be disposed at 90 degrees relative to the third segment 506(3).

The second segment 512(2) may cross over the second crease 500(2) and/or a portion of the fifth crease 500(5), such as the third segment 506(3). In some instances, the second segment 512(2) is parallel to the second segment 506(2) of the fifth crease 500(5). As such, the second segment 512(2) may extend in a direction, from the first segment 512(1), to the first side 130 and/or the second end 138. As shown, a first portion of the second segment 512(2) may be disposed on a first side of the third segment 506(3), and a second portion of the second segment 512(2) may be disposed on a second side of the third segment 506(3).

In some instances, the tenth crease 500(10) includes a two segments, such as a first segment 514(1) and a second segment 514(2). The first segment 514(1) may extend from the first end 136, in a direction towards the second end 138 (e.g., in the Z-direction). The first segment 514(1) may be parallel to the first crease 500(1), the second crease 500(2), the first segment 506(1) of the fifth crease 500(5), and/or first segment 512(1) of the ninth crease 500(9). In some instances, the first segment 514(1) may be longer in length than the first segment 512(1). Additionally, the first segment 514(1) may be located closer to a center of the packaging material 118 (e.g., in the X-direction). Stated alternatively, in some instances, the first segment 512(1) may be located closer to the first side 130, while the first segment 514(1) may be located closer to the second side 132.

The second segment 514(2) may extend from the first segment 514(1). In some instances, the second segment 514(2) is disposed at 135 degrees relative to the first segment 514(1). Additionally, or alternatively, the second segment 514(2) may be disposed at 90 degrees relative to the third segment 506(3). In some instances, the second segment 514(2) may adjoin or connect to the third segment 506(3) of the fifth crease 500(5). The second segment 514(2) may adjoin or connect to the third segment 506(3) of the fifth crease 500(5) at a location that is farther from the first segment 506(1), as compared to a location at which the second segment 512(2) intersection or adjoins to the third segment 506(3). However, in some instances, the second segment 514(2) may not cross over the third segment 506(3) of the fifth crease 500(5). In some instances, the second segment 514(2) is parallel to the second segment 506(2) of the fifth crease 500(5) and/or the second segment 512(2) of the nineth crease 500(9). As such, the second segment 514(2) may extend in a direction, from the first segment 514(1), to the first end 136 and/or the second side 132. In some instances, the second segment 514(2) may be greater in length than the second segment 512(2).

In some instances, portions of the cutting mechanism 124 that form the creases 500(5)-(16) may be adjusted depending upon the size of the container 142 to be formed. However, in some instances, portions of the cutting mechanism 124 that form the creases 500(5)-(16) may be static, and move with the portions of the cutting mechanism that form the creases 500(1)-(4), such that the creases 500(5)-(16) maintain their relationships with the creases 500(1)-(4), respectively. In some instances, the portions of the cutting mechanism 124 that form the creases 500(9)-(16) may be static across various sized containers. In other instances, the portions of the cutting mechanism 124 that form the creases 500(9)-(16) may be variable across various sized containers, for example, to create longer segments.

Although the packaging material 118 is described as being formed with a certain number of the creases 500, the packaging material 118 may be formed with a greater number or a lesser number of the creases 500. In some instances, the creases 500(1)-(16), or the segments thereof, may be shaped, oriented, or disposed differently than shown. For example, the creases 500(1)-(16) may include a lengths that are smaller than or greater than those shown.

The creases 500(9)-(16) permit the third section 508 and the fourth section 510 to be folded inwards without lifting up the entire packaging material 118 at the first end 136 and the second end 138. In other words, because of the creases 500(9)-(16), the third section 508 and the fourth section 510 may fold upwards, between the second crease 500(2) and the third crease 500(3), without an entirety of the packaging material 118 at the first end 136 and the second end 138 folding upwards. In doing so, the third section 508 and the fourth section 510 are able to enclose the cavity 128.

In some instances, the creases 500(1)-(4) may be considered a first plurality of the creases 500, the creases 500(5)-(8) may be considered a second plurality of the creases 500, the creases 500(9), (12), (13), and (16) may be considered a third plurality of the creases 500, and the creases 500(10), (11), (14), and (15) may be considered a fourth plurality of the creases 500. The creases 500 of the first plurality (e.g., the creases 500(1)-(4)) may be the same, the creases 500 of the second plurality (e.g., the creases 500(5)-(8)) may be the same, the creases 500 of the third plurality (e.g., the creases 500(9), (12), (13), and (16)) may be the same, and the creases 500 of the fourth plurality (e.g., the creases 500(10), (11), (14), and (15)) may be the same. In some instances, the first plurality of the creases 500, the second plurality of the creases 500, the third plurality of the creases 500, and the fourth plurality of the creases 500 may be formed at the same time, or at different stations, sections, etc. of the cutting mechanism 124 (or another mechanism). Moreover, each of the first plurality of the creases 500, the second plurality of the creases 500, the third plurality of the creases 500, and the fourth plurality of the creases 500 may have the same components, segments, etc. but may be oriented differently depending upon the side, or end, the creases 500 are formed. For example, the nineth crease 500(9) and the twelfth crease 500(12) may be the same, but oriented differently.

In some instances, the cutting mechanism 124 includes different set(s) of cutters, rollers, or dies that create the first plurality of creases 500, the second plurality of the creases 500, the third plurality of the creases 500, and the fourth plurality of the creases 500. In some instances, the packaging material 118 may not include all of the creases 500(1)-(16). For example, the packaging material 118 may only include the creases 500(9)-(16).

Figure 6:
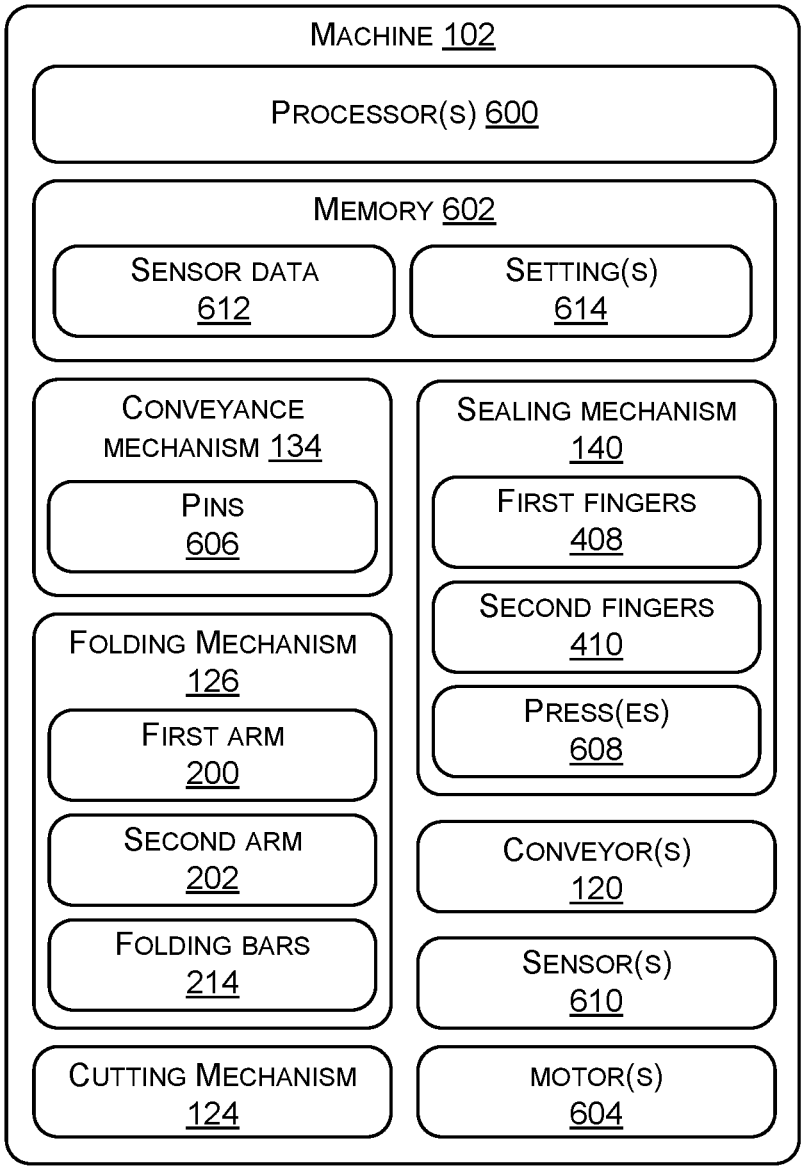
FIG. 6 illustrates example components of the machine of FIG. 1, according to examples of the present disclosure.

FIG. 6 illustrates example components of the machine 102, according to examples of the present disclosure. The machine 102 is shown including processor(s) 600 and memory 602, where the processor(s) 600 may perform various functions and operations associated with forming and sealing the container 142, and the memory 602 may store instructions executable by the processor(s) 600 to perform the operations described herein.

The machine 102 includes the conveyor(s) 120 that convey the packaging material 118 throughout the machine 102.

In some instances, the conveyor(s) 120 may represent belt drives. The conveyor(s) 120 may be powered via one or more motor(s) 604. Example motor(s) 604 include linear cylinders, whether pneumatic or fluid, screw drives, motors, and so forth. In some instances, the machine 102 may include multiple conveyor(s) 120 dispose along the machine 102, or a single conveyor 120 disposed along the machine 102. In instances in which multiple conveyor(s) are included, the conveyor(s) 120 may transfer the packaging material 118 between one another.

As discussed above, the machine 102 includes the conveyance mechanism 134 having pins 606 (e.g., the first pin 208 and the second pin 210) that engage with the packaging material 118. In some instances, the machine 102 may include multiple conveyance mechanisms having their own respective pins 606 for conveying the packaging material 118 through the machine 102. The pins 606 are configured to engage with ends of the packaging material 118, such as a first end 136 and the second end 138, to prevent the packaging material 118 unfolding and the item(s) 104 exiting the cavity 128. In some instances, the distance between the pins 606 is variable, depending upon a size of the container 142. The conveyance mechanism 134 may also include suction mechanisms that suction to the packaging material 118 to prevent the packaging material 118 reorientating as the cavity 128 is formed and/or as the packaging material 118 is conveyed. In some instances, the conveyor(s) 120 are a component of the conveyance mechanism 134, and the motor(s) 604 may actuate the conveyance mechanism 134 and/or the pins 606.

The machine 102 includes the sealing mechanism 140 having press(es) 608, such as the first press 204 and the second press 206, for example. The first press 204 and the second press 206 may seal ends of the packaging material 118, or the container 142, such as the first end 136 and the second end 138. In some instances, the sealing mechanism 140 includes the first fingers 408 and the second fingers 410 that form gusset(s) (e.g., inward facing gusset(s)) along the sides of the packaging material 118 and/or at the ends of the packaging material 118. The first fingers 408 and the second fingers 410 may also assist in preventing the packaging material 118 at the first end 136 and the second end 138 unfolding prior to sealing (e.g., the third section 508 and the fourth section 510).

The machine 102 includes the folding mechanism 126 having the first arm 200 and the second arm 202 for forming the container 142. Additionally, the folding mechanism 126 includes the folding bars 214 for sealing the container 142. The machine 102 also includes the cutting mechanism 124 that may cut the packaging material 118 according to the size of the container 142 to be formed. In some instances, the cutting mechanism 124 may also include various dies, rollers, etc. that form the creases 500 on the packaging material 118.

In some instances, the machine 102 includes various sensor(s) 610 for monitoring the machine 102. The sensor(s) 610 may include imaging sensor(s), microphone(s), accelerometer(s), displacement sensor(s), ultrasonic sensor(s), and so forth. The sensor(s) 610 may generate sensor data 612 that is stored on the memory 602. By way of example, the sensor(s) 610 may measure a size of the compartment 114 of the tote 106. Using the size of the compartment 114, the packaging material 118 may be sized and cut to length, and the cutting mechanism 124 may form the creases 500 on the packaging material 118. As an additional example, the sensor(s) 610 may determine when the tote 106 has deposited the item(s) 104, for use in forming the cavity 128.

In some instances, the machine 102 may operate according to setting(s) 614 stored in the memory 602. The setting (s) 614 may indicate, for example, when the cavity 128 is to be formed. The setting(s) 614 may also indicate the speed and/or timing at which the conveyance mechanism 134 is to transfer the packaging material 118.

As used herein, a processor, such as the processor(s) 600, may include multiple processors and/or a processor having multiple cores. Further, the processor(s) may comprise one or more cores of different types. For example, the processor(s) may include application processor units, graphic processing units, and so forth. In one implementation, the processor(s) may comprise a microcontroller and/or a microprocessor. The processor(s) may include a graphics processing unit (GPU), a microprocessor, a digital signal processor or other processing units or components known in the art. Alternatively, or in addition, the functionally described herein can be performed, at least in part, by one or more hardware logic components. For example, and without limitation, illustrative types of hardware logic components that may be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, each of the processor(s) may possess its own local memory, which also may store program components, program data, and/or one or more operating systems.

Memory, such as the memory 602, may include volatile and nonvolatile memory, removable and non-removable media implemented in any method or technology for storage of information, such as computer-readable instructions, data structures, program component, or other data. Such memory may include, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device. The memory may be implemented as computer-readable storage media ("CRSM"), which may be any available physical media accessible by the processor(s) to execute instructions stored on the memory. In one basic implementation, CRSM may include random access memory ("RAM") and Flash memory. In other implementations, CRSM may include, but is not limited to, read-only memory ("ROM"), electrically erasable programmable read-only memory ("EEPROM"), or any other tangible medium which can be used to store the desired information and which can be accessed by the processor(s).

FIGS. 7A-7K illustrate a progression of operations to form the container 142 around the item(s) 104, according to examples of the present disclosure. In FIGS. 7A-7K, portions of the machine 102 are simplified in order to illustrate the operations to form the container 142.

Figure 7A:
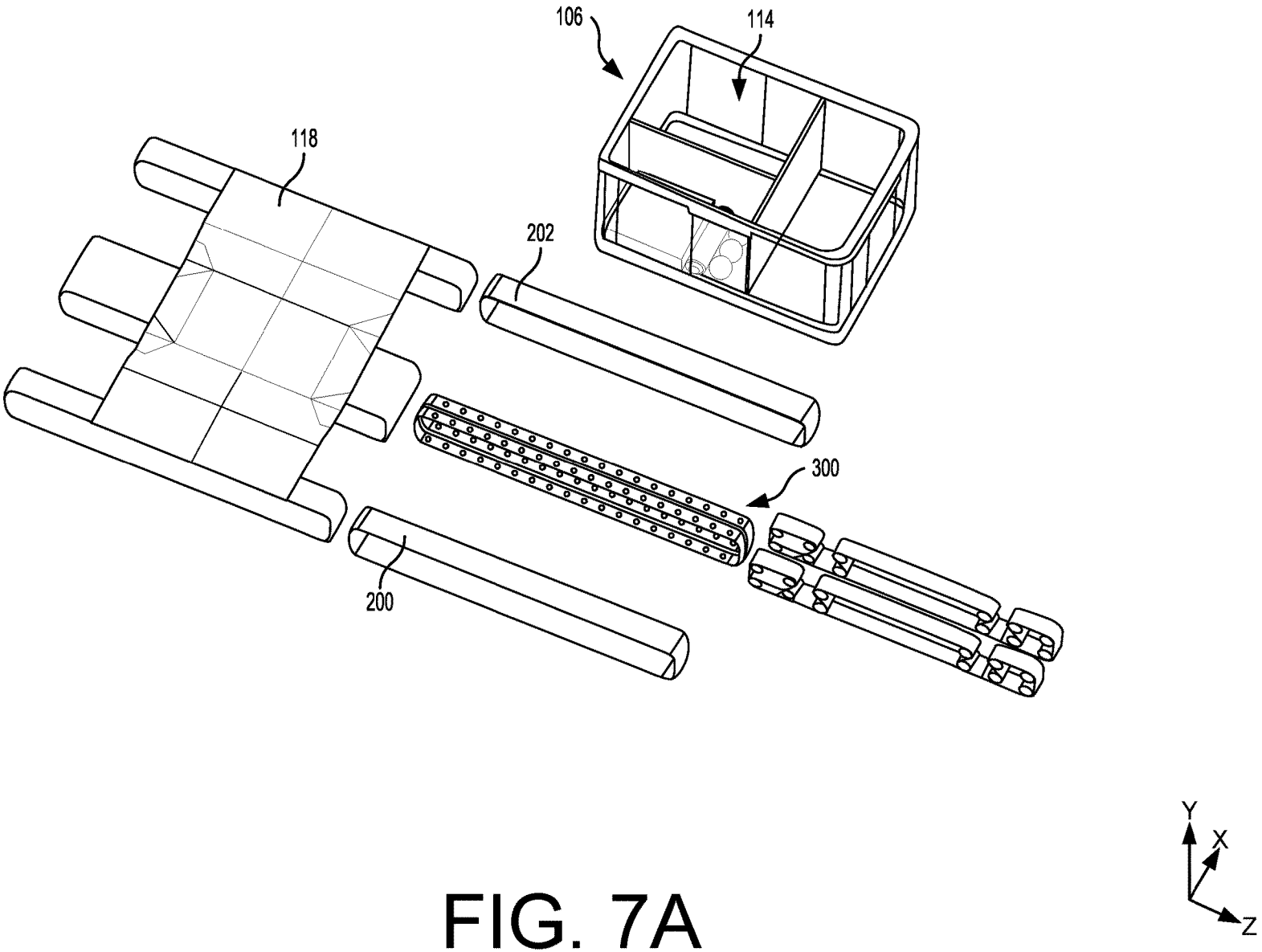
FIGS. 7A-7K illustrate a sequence of operations performed by the machine of FIG. 1 to form a container around item(s) and seal the container around the item(s), according to examples of the present disclosure.

In FIG. 7A, the packaging material 118 may have the creases 500(1)-(16) formed thereon. The cutting mechanism 124 may cut the packaging material 118 to size, and the dies or rollers that form the creases 500(1)-(16) may be actuated to form the creases 500(1)-(16) depending upon the size of the container 142 to be formed, the number of item(s) 104, the size of the item(s) 104 and so forth. For example, depending upon the size of the compartment 114 within the tote 106, the packaging material 118 may be cut accordingly, and the creases 500(1)-(16) may be formed on the packaging material 118. As shown, the central conveyors 300 of the conveyance mechanism 134 may be open to receive the packaging material 118, and the first arm 200 and the second arm 202 of the folding mechanism 126 may be in a retracted state to receive the packaging material 118. The tote 106 is disposed adjacent to the second arm 202.

Figure 7B:
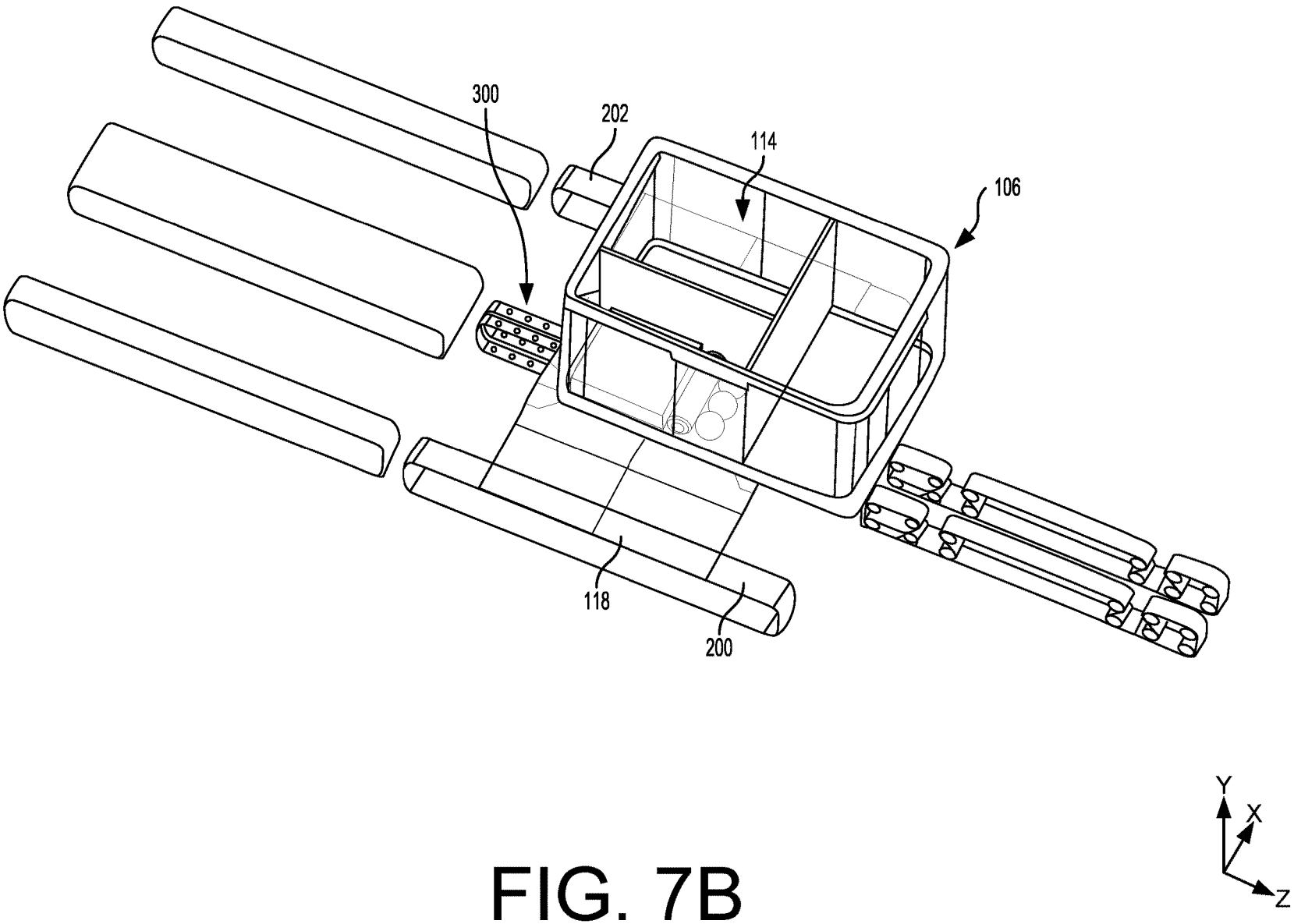

In FIG. 7B, the packaging material 118 may be advanced onto or over the central conveyors 300, the first arm 200, and the second arm 202. As the packaging material 118 arrives at the central conveyors 300, or substantially simultaneous therewith, the tote 106 may be moved into a position vertically above the packaging material 118. The tote 106 may be moved into a position such that the compartment 114 of the tote 106 is centered over the packaging material 118, or the cavity 128 to be formed within the packaging material 118. As such, the tote 106 may not be centered on the packaging material 118. Moreover, the suction mechanism of the central conveyors 300 may suction the packaging material 118 to prevent the packaging material 118 reorienting as the container 142 is formed.

Figure 7C:
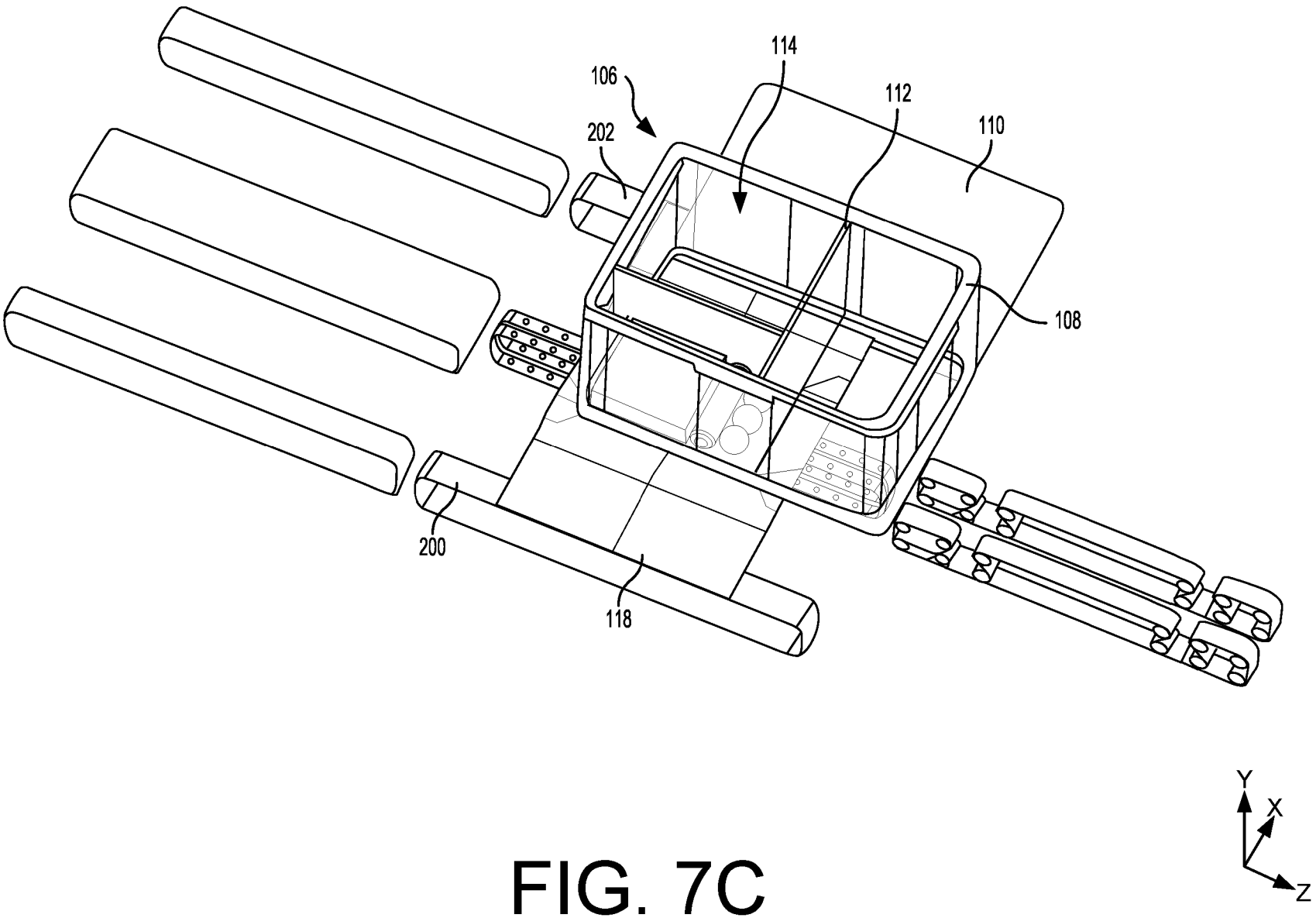

In FIG. 7C, the bottom 110 of the tote 106 may be opened to cause the item(s) 104 to fall out of the tote 106 and onto the packaging material 118. As the item(s) 104 are deposited onto the packaging material 118, the tote 106 may reside vertically above the packaging material 118, and the item(s) 104 may be constrained from rolling off the packaging material 118, for example, via an engagement between the item(s) 104 and the sidewalls 108 and/or the partitions 112 of the tote 106. That is, sides of the item(s) 104 may be in contact with the sidewalls 108 and/or the partitions 112 to prevent the item(s) 104 rolling off the packaging material 118.

Figure 7D:
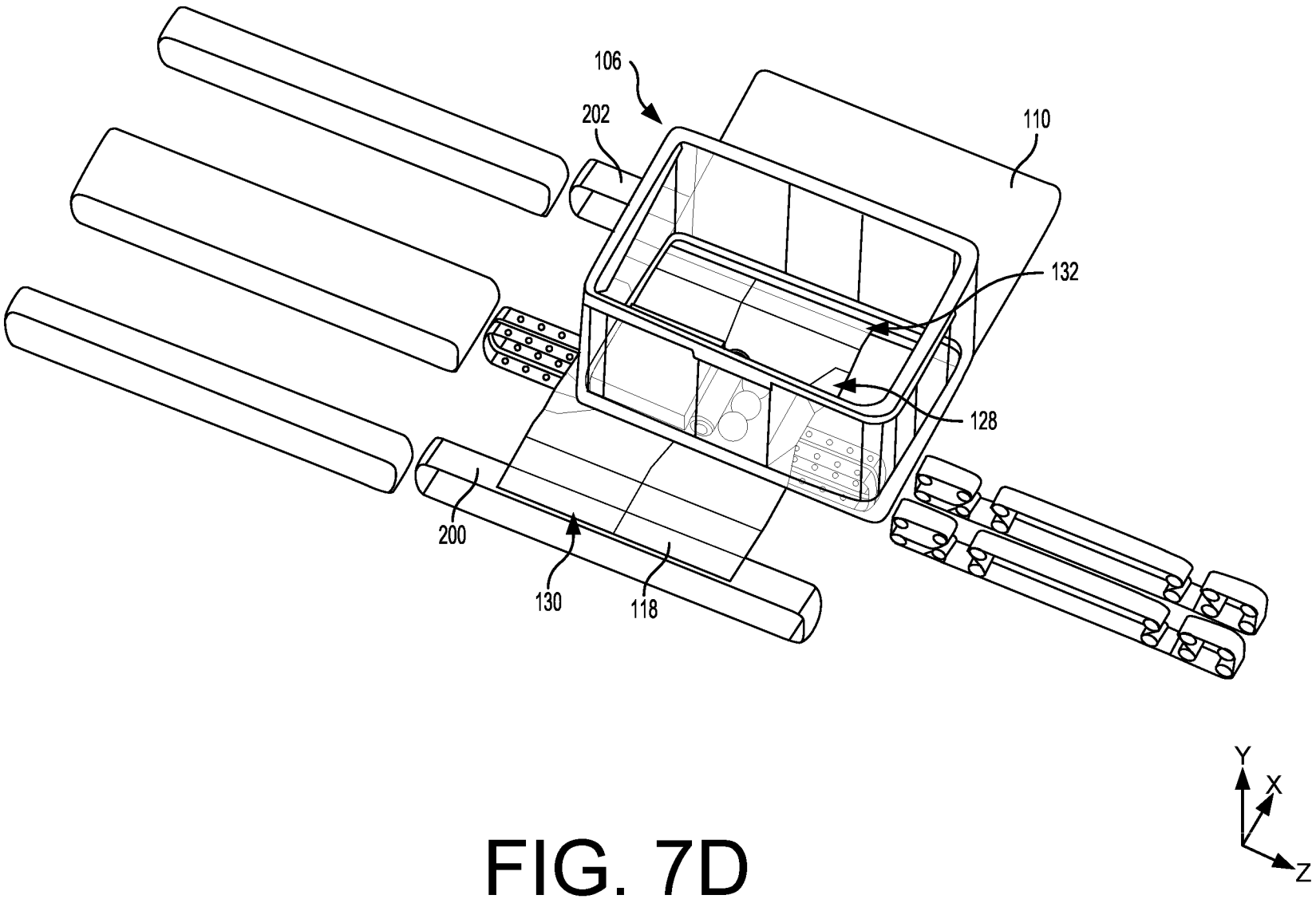

In FIG. 7D, the tote 106 may be translated vertically upwards, away from the packaging material 118, and the cavity 128 may be at least partially formed within the packaging material 118. In FIG. 7D, the partitions 112 of the tote 106 are shown removed to illustrate the formation of the cavity 128. For example, as the tote 106 is moved vertically upwards, the first arm 200 may engage with the first side 130 of the packaging material 118, the second arm 202 may engage with the second side 132 of the packaging material 118, the first pin 208 may engage with the first end 136 of the packaging material 118, and the second pin 210 may engage with the second end of the packaging material 118. Formation of the cavity 128 may be simultaneous with or as the tote 106 is being lifted upwards in order for the item(s) 104 to remain on the packaging material 118. That is, the item(s) 104 become retained in the cavity 128. As introduced above, the formation of the cavity 128 is assisted, at least in part, via the creases 500(1)-(16). Moreover, the tote 106 is translated vertically upwards to provide sufficient clearance for the first side 130 and the second side 132 to be folded inwards, via the first arm 200 and the second arm 202, respectively.

Figure 7E:
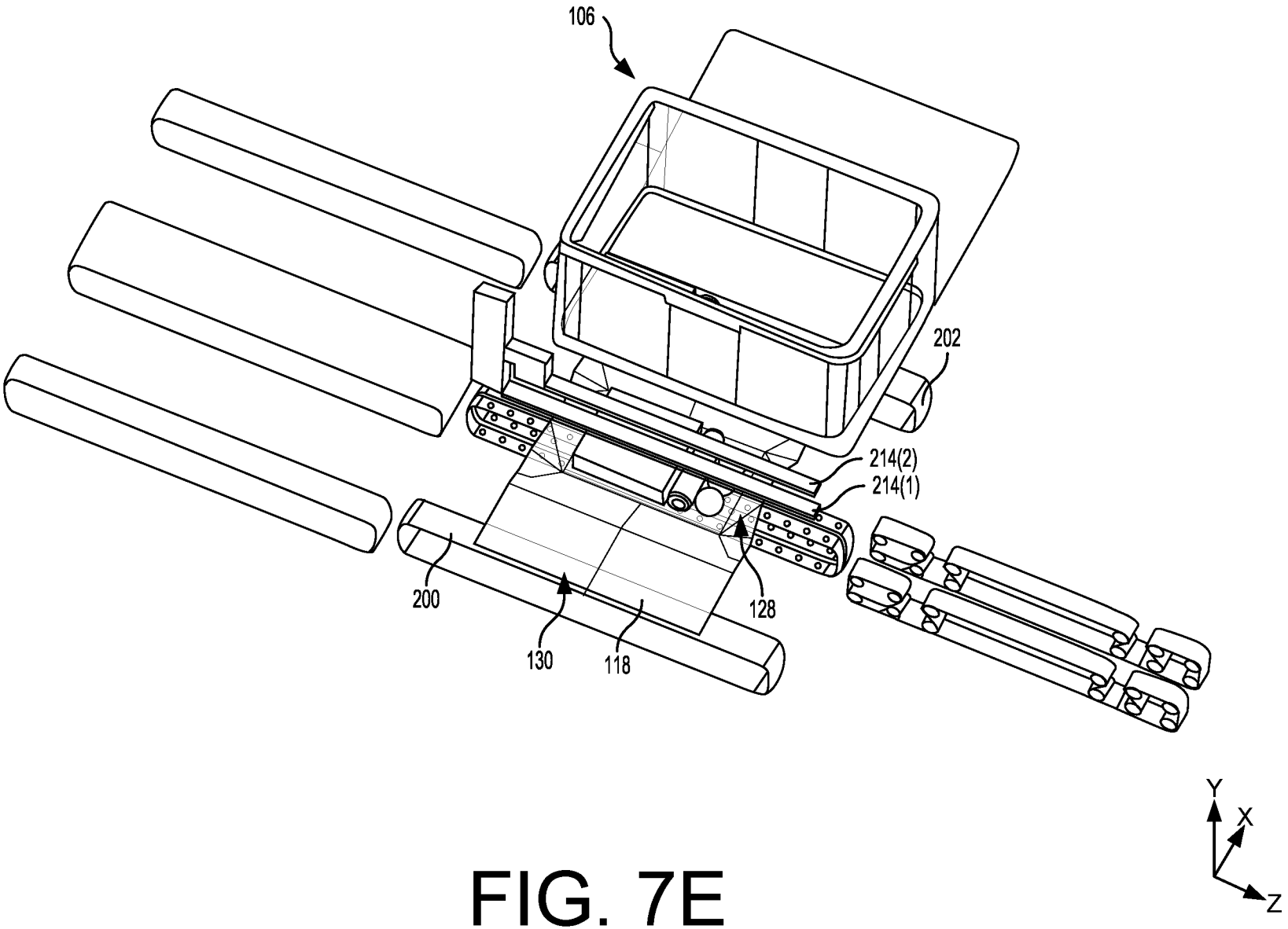

In FIG. 7E, after the tote 106 is lifted upwards to vertically translate away from the packaging material 118 the tote 106 may be moved out of the way, for example, to receive other item(s). This allows another tote with other item(s) to be moved into position, and/or to allow the first side 130 and the second side 132 of the packaging material 118 to be folder over one another and form the container 142. The folding mechanism 126 may also include the folding bar(s) 214. In some instances, the folding bar(s) 214 serve to adhere the first side 130 and the second side 132 to one another, over a top of the item(s) 104. For example, a first of the folding bar(s) 214(1) may be disposed above item(s) 104, inside the cavity 128, while a second of the folding bar(s) 214(2) may be disposed outside the cavity 128. The second of the folding bar(s) 214(2), however, may be pressed into the first of the folding bar(s) 214(1) to secure the first side 130 and the second side 132 of the packaging material 118 to one another. In doing so, the first of the folding bar(s) 214(1) may prevent damage to the item(s) 104 and the container 142 may be enclosed along a top. The folding bars 214 are capable of translating towards and away from one another.

Figure 7F:
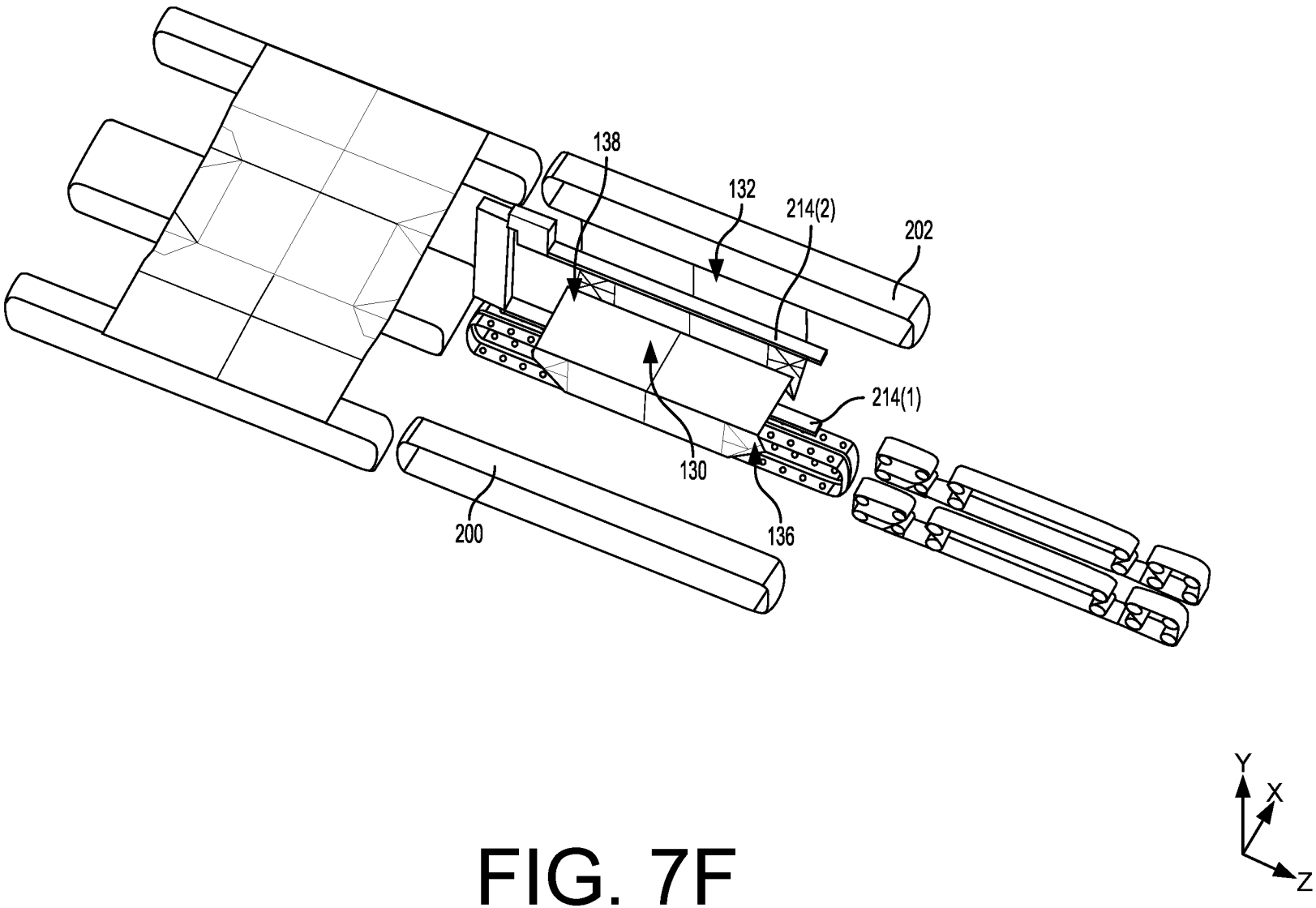

In FIG. 7F, after the first side 130 is folded over the item(s) 104, for example, via the first arm 200, the second arm 202 may fold the second side 132 over the first side 130. Therein, the first of the folding bar(s) 214(1) may be disposed within the cavity 128, and the second of the folding bar(s) 214(2) may press the second side 132 of the packaging material 118 into the first side 130 of the packaging material 118, pressing against the first of the folding bar(s) 214(1). For example, the first of the folding bar(s) 214(1) may be interposed between the item(s) 104 and the first side 130 of the packaging material 118 to provide a structure against which the second of the folding bar(s) 214(2), once the second side 132 is folded over, is pressed against. As such, to seal the container 142 along the top, the first side 130 of the packaging material 118 and the second side 132 of the packaging material 118 may be compressed together. Placing the first of the folding bar(s) 214(1) underneath the first side 130 of the packaging material 118 avoids the packaging material 118 being pressed against the item(s) 104 as the container 142 is sealed along the top. As further shown, another piece of the packaging material 118 may be in position to move onto the conveyance mechanism 134 once the packaging material 118 is folded.

Moreover, in FIG. 7F, and although not shown, the first pin 208 and the second pin 210 engage with the first end 136 and the second end 138 of the packaging material 118 to prevent the item(s) 104 spilling out of the container 142 as the first side 130 and the second side 132 are folded. After the first side 130 and the second side 132 are folded over, however, the first pin 208 and the second pin 210 maintain an engagement with the first end 136 and the second end 138 to avoid those portions of the packaging material 118 unfolding and permitting the item(s) 104 to spill out from within the container 142.

Figure 7G:
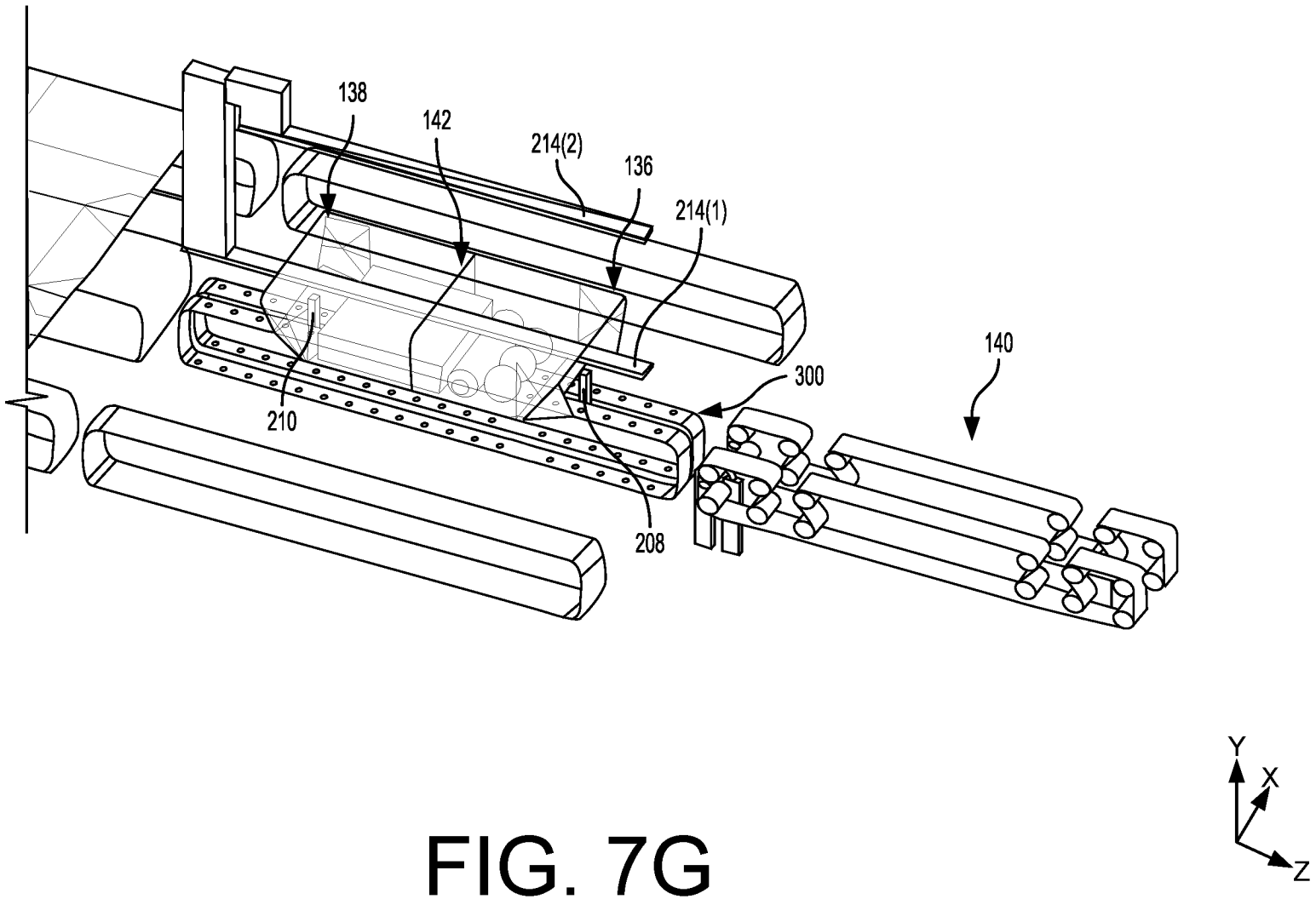

In FIG. 7G, the second of the folding bars(s) 214(2) may retract (e.g., translate vertically upwards) away from the container 142. Meanwhile, the first of the folding bars(s) 214(1) may remain within the cavity 128. The first pin 208 and the second pin 210 are shown engaged with the first end 136 and the second end 138 to prevent the packaging material 118 unfolding at the first end 136 and the second end 138, respectively. Therein, the conveyance mechanism 134, such as the central conveyors 300, may convey the container 142 to the sealing mechanism 140. During this instance, the first of the folding bar(s) 214(1) may slide out from within the cavity 128.

Figure 7H:
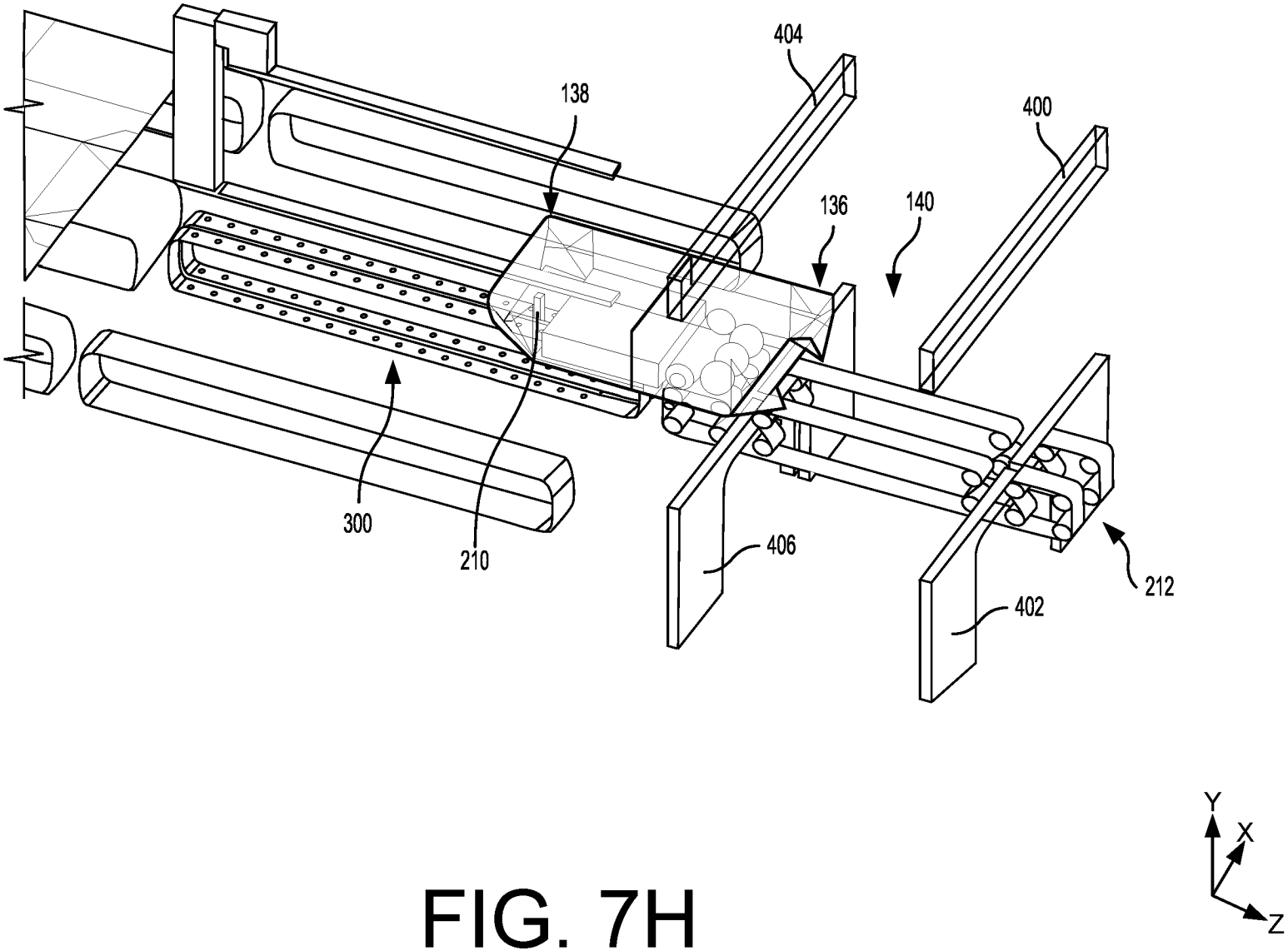
Figure 7I:
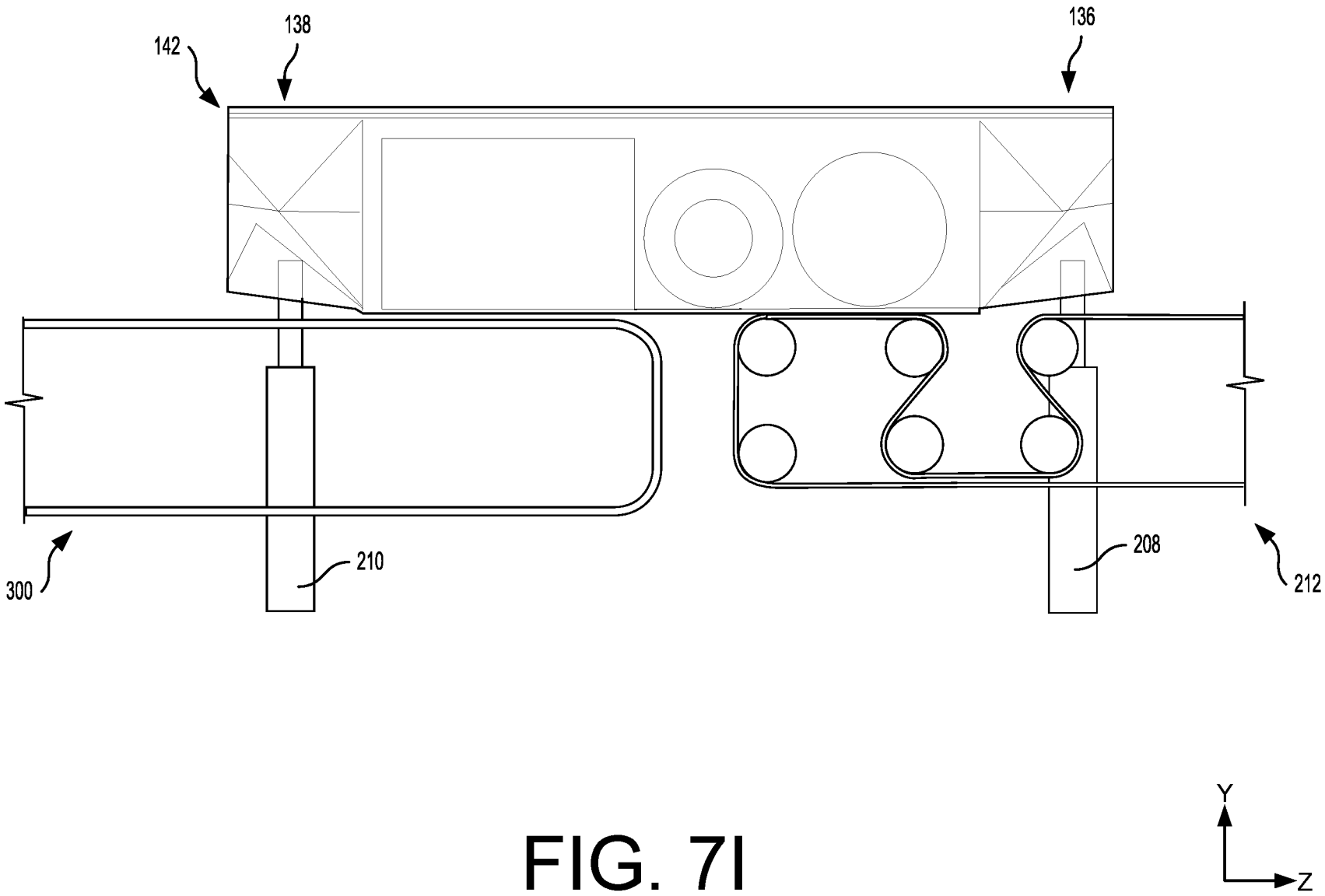

In FIGS. 7H and 7I, the conveyance mechanism 134 moves the container 142 to the sealing mechanism 140. For example, the first pin 208 may engage with the first end 136 of the packaging material 118, and the second pin 210 may engage with the second end 138 of the packaging material 118. As the conveyance mechanism 134 moves, for example, from the folding mechanism 126 to the sealing mechanism 140, the second pin 210 may push (e.g., exert force) on the packaging material 118. Moreover, the engagement between the first pin 208 and the second pin 210 with the packaging material 118 prevents the packaging material 118 unfolding, thereby preventing the item(s) 104 within the container 142 spilling out from the cavity 128. As also shown, the conveyance mechanism 134 may transfer the container 142 from the central conveyors 300 to the central conveyors 212 of the sealing mechanism 140.

Figure 7J:
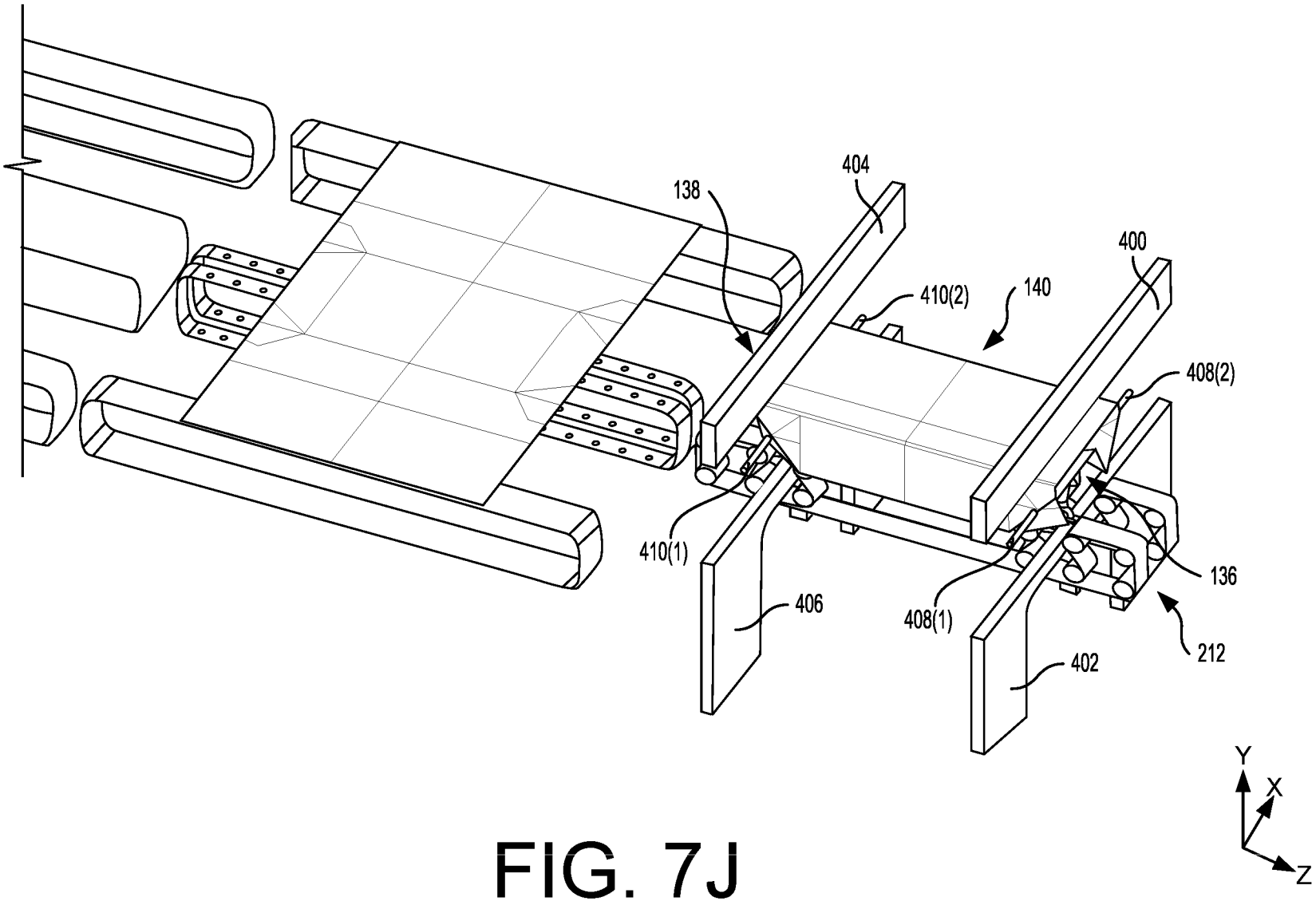

In FIG. 7J, the packaging material 118 arrives at the sealing mechanism 140 to enclose the cavity 128 and form the container 142. As the packaging material 118 arrives at the sealing mechanism 140, the first fingers 408 and the second fingers 410 of the sealing mechanism 140 may engage with the packaging material 118 to prevent the packaging material 118 unfolding as the first pin 208 and the second pin 210 are retracted. For example, the first finger 408(1) may engage with the packaging material 118 along the first side 130, at the first end 136, while the second finger 408(2) may engage with the packaging material 118 along the second side 132 and at the first end 136. The first finger 408(1) and the second finger 410(2) may engage with the packaging material 118 while, during, or after the first pin 208 retracts. The first finger 408(1) and the second finger 408(2) prevent the first end 136 of the packaging material 118 unfolding as the first pin 208 retracts. In some instances, the first finger 408(1) and the second finger 408(2) form gussets along the first side 130 and the second side 132 during contact with the packaging material 118.

Similarly, the first finger 410(1) may engage with the packaging material 118 along the first side 130, at the second end 138, while the second finger 410(2) may engage with the packaging material 118 along the second side 132 and at the second end 138. The first finger 410(1) and the second finger 410(2) may engage with the packaging material 118 while, during, or after the second pin 210 retracts. The first finger 410(1) and the second finger 410(2) prevent the second end 138 of the packaging material 118 unfolding as the second pin 210 retracts. In some instances, the first finger 410(1) and the second finger 410(2) form gussets along the first side 130 and the second side 132 during contact with the packaging material 118.

Figure 7K:
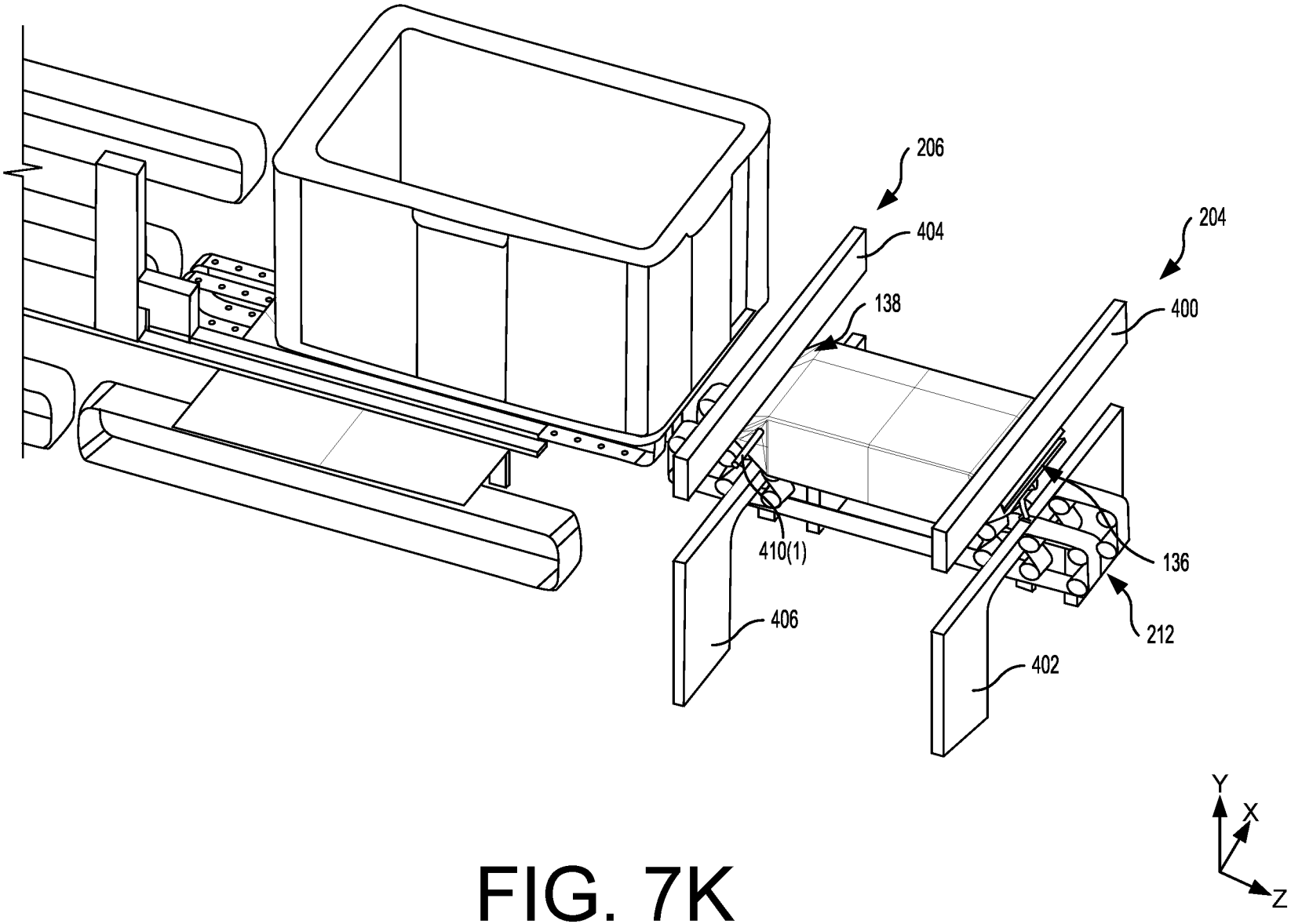

In FIG. 7K, the first press 204 and the second press 206 may enclose ends of the packaging material 118 to form the container 142. For example, the first upper press 400 and the first lower press 402 may be actuated to compress the first end 136 of the packaging material 118, while the second upper press 404 and the second lower press 406 may be actuated to compress the second end 138 of the packaging material 118. Prior to the first press 204 and the second press 206 enclosing the ends of the packaging material 118, the first pin 208 and the second pin 210 may retract. Additionally, while the first pin 208 and the second pin 210 retract, the first fingers 408 and the second fingers 410 are actuated to form the gussets and prevent the first end 136 and the second end 138 of the packaging material 118 unfolding. The first fingers 408 and the second fingers 410 may engage with the packaging material 118 as the first press 204 and the second press 206 seal the ends. In some instances, the first fingers 408 and the second fingers 410 prevent the packaging material 118 unfolding such that the first press 204 and the second press 206 may seal the packaging material 118 at the first end 136 and the second end 138, respectively. After the container 142 is sealed, the central conveyors 212 may discharge the container 142 from the machine 102. To permit such, the first press 204, the second press 206, and the first fingers 408 and the second fingers 410 may be retracted.

In some instances, the first lower press 402 is composed of two separate members that are spaced apart in the X-direction. The spacing between the members of the first lower press 402 permit the first pin 208 to traverse therebetween. Once the first pin 208 moves between the members of the first lower press 402, the members of the first lower press 402 may be brought together (e.g., in the X-direction). From there, the first upper press lower press 400 and the first lower press 402 may be actuated in the vertical direction to seal the first end 136 of the container 128.

Figure 8:
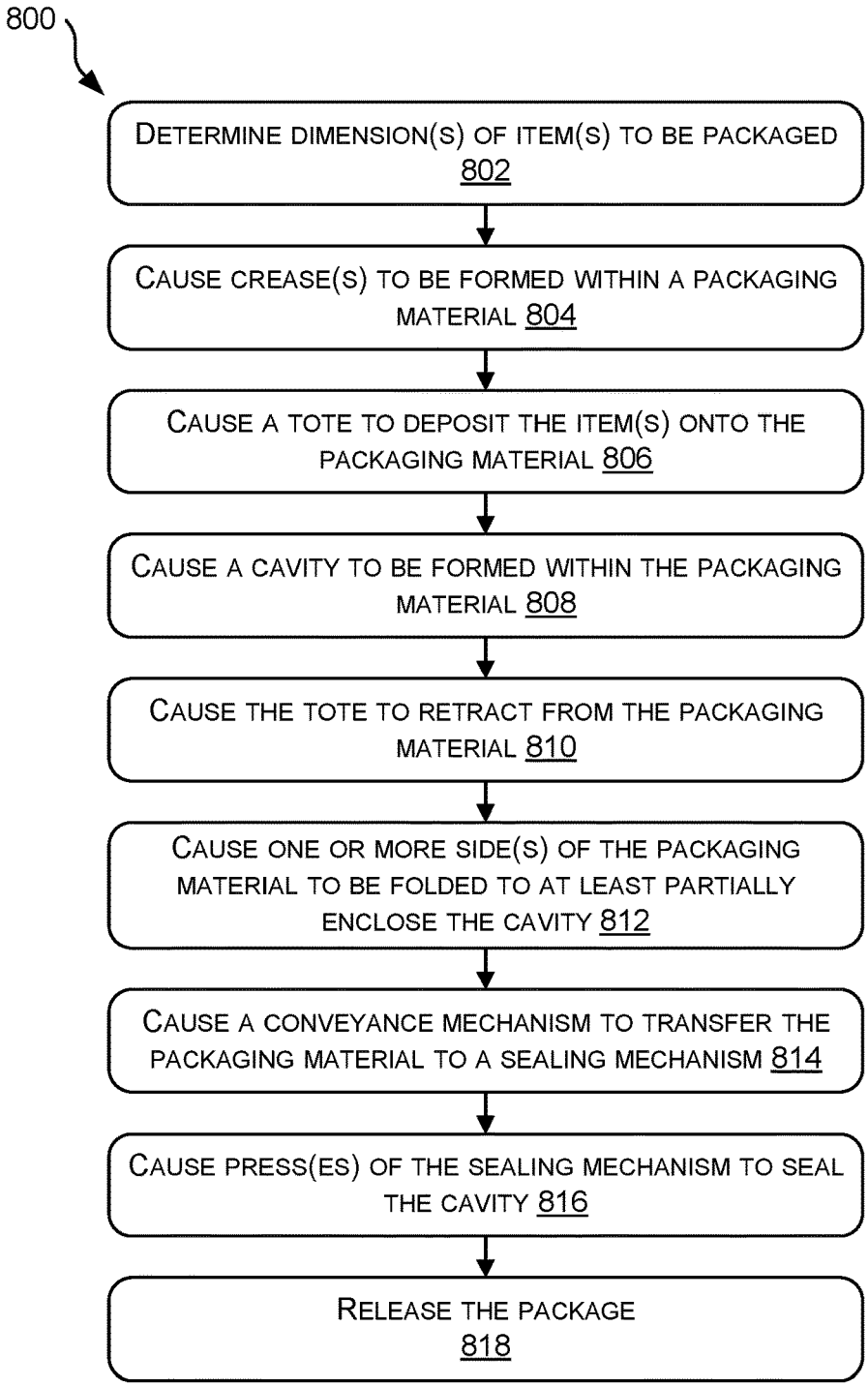
FIG. 8 illustrates an example process to form a container around item(s), according to examples of the present disclosure.

FIG. 8 illustrates an example process 800 for forming a cavity within a container and sealing the container around items. The process 800 described herein is illustrated as collections of blocks in logical flow diagrams, which represent a sequence of operations, some or all of which may be implemented in hardware, software, or a combination thereof. In the context of software, the blocks may represent computer-executable instructions stored on one or more computer-readable media that, when executed by one or more processors, program the processors to perform the recited operations. Generally, computer-executable instructions include routines, programs, objects, components, data structures and the like that perform particular functions or implement particular data types. The order in which the blocks are described should not be construed as a limitation, unless specifically noted. Any number of the described blocks may be combined in any order and/or in parallel to implement the process, or alternative processes, and not all of the blocks need be executed. For discussion purposes, the process 800 is described with reference to the environments, architectures, devices, and systems described in the examples herein, such as, for example those described with respect to FIGS. 1-7K, although the process 800 may be implemented in a wide variety of other environments, architectures, devices, and systems.

At 802, the process 800 may include determining dimension(s) of item(s) to be packaged. For example, sensor(s) of the machine 102 may determine the dimensions of the item(s) 104. The dimension(s) of the item(s) 104 are used to appropriately size a container around the item(s) 104. In some instances, the dimension(s) of the item(s) 104 are determined based on the size of the compartment 114 within the tote 106. For example, the item(s) 104 may be compactly stored in the tote 106, within the compartment 114, and knowing the size of the compartment 114 may be used to determine the dimension(s) of the item(s) 104. In some instances, the item(s) 104 may be imaged, scanned, etc. for determining the dimension(s).

At 804, the process 800 may include causing crease(s) to be formed within a packaging material. For example, the cutting mechanism 124, or other dies/rollers of the machine 102, may form the creases 500. In some instances, the creases 500 are made at locations on the packaging material 118 based at least in part on the dimension(s) of the item(s) 104. For example, the creases 500 may be used to form the cavity 128 that receives the item(s) 104 once deposited from the tote 106. In doing so, the location of the creases 500 permit the cavity 128 to be formed. The cutting mechanism 124, or the other dies/rollers are adjustable such that the creases 500 are created at the appropriate positions for forming the cavity 128 and permitting the packaging material 118 to be folded around the item(s) 104. For example, based on a size of the item(s) 104 and/or a size of the cavity 128 that receives the item(s) 104, the creases 500 may be made on the packaging material 118 at appropriate locations.

At 806, the process 800 may include causing a tote to deposit the item(s) onto the packaging material 118. For example, the tote 106 may be moved into position above the packaging material 118, with the crease(s) 500 formed therein, and open the bottom 110. In doing so, the item(s) 104 may fall out of the tote 106 and onto the packaging material 118. At this point, however, the item(s) 104 may be in contact with the sidewalls 108 and/or the partitions 112 of the tote 106 to prevent the item(s) 104 rolling off the packaging material 118.

At 808, the process 800 may include causing a cavity to be formed within the packaging material. In some instances, the cavity 128 is formed via an actuation of the folding mechanism 126, including the first arm 200 and the second arm 202, and/or the conveyance mechanism 134, such as the first pin 208 and the second pin 210. The packaging material 118 is folded, for example, around the item(s) 104 in order to form the cavity 128 and such that the item(s) 104 reside within the cavity 128. At the same time, or to form the cavity 128, the tote 106 is displaced upwards, vertically away from the packaging material 118, to permit the packaging material 118 to be folded and form the cavity 128. Movement of the tote 106 away from the packaging material 118 may be at the same time, or near in time, to the first arm 200 and the second arm 202 engaging with the first side 130 and the second side 132 to form portions of the cavity 128, and the first pin 208 and the second pin 210 engaging with the first end 136 and the second pin 210 to form portions of the cavity 128.

In some instances, the cavity 128 may be formed over a first period of time. For example, the first arm 200, the second arm 202, the first pin 208, and the second pin 210 may fold the packaging material 118 to form the cavity 128 over a first period of time. During this first period of time, the first arm 200, the second arm 202, the first pin 208, and the second pin 210 may be actuated to engage the packaging material 118.

At 810, the process 800 may include causing the tote to retract from the packaging material. For example, the tote 106 may be vertically and/or horizontally translated away from the packaging material 118 to permit the first side 130 and the second side 132 of the packaging material 118 to be folded and enclose the cavity 128 along a top. Once folded, for example, the folding bars 214 may be used to seal the packaging material 118 along the top.

In some instances, the tote 106 may be retracted from the packaging material 118 over a second period of time. For example, the tote 106 may move away from the packaging material 118 during the second period of time. The second period of time may at least partially overlap with the first period of time in order for the cavity 128 to be formed at least partially contemporaneously with the tote 106 being moved away from the packaging material 118.

At 812, the process 800 may include causing one or more side(s) of the packaging material to be folded to at least partially enclose the cavity. For example, the first side 130 may be folded over the item(s) 104 and thereafter, the second side 132 maybe folded over the first side 130. Folding the first side 130 and the second side 132 encloses the cavity 128 along the top.

At 814, the process 800 may include causing a conveyance mechanism to transfer the packaging material to a sealing mechanism. For example, the conveyance mechanism 134, with the first pin 208 engaged with the first end 136 of the packaging material 118, and the second pin 210 engaged with the second end 138 of the packaging material 118, may move the packaging material 118 onto the sealing mechanism 140. For example, the central conveyors 300 may actuate to move the packaging material 118 onto the conveyance mechanism 134. The first pin 208 and the second pin 210 maintain an engagement with the packaging material 118 to prevent the packaging material 118 unfolding at the first end 136 and the second end 138, respectively.

At 816, the process 800 may include causing press(es) of the sealing mechanism to seal the cavity. For example, the first press 204 may be actuated to seal the packaging material 118 at the first end 136, and the second press 206 may be actuated to seal the packaging material 118 at the second end 138. In some instances, the first press 204 and the second press 206 seal the packaging material 118, the first pin 208 and the second pin 210 may be retracted. To hold the position of the packaging material 118 at the first end 136 and the second end 138, respectively, the sealing mechanism 140 may include the first fingers 408 and the second fingers 410.

At 818, the process 800 may include causing a package to be released. In some instances, causing the packaging to be released may include opening the press(es) of the machine 102 such that the package may be removed from the machine 102 and further processed.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative some embodiments that fall within the scope of the claims of the application.

What is claimed is:

1. A method, comprising:

causing a plurality of first creases to be formed within a packaging material;

causing a plurality of second creases to be formed within the packaging material;

causing one or more items to be deposited on the packaging material;

causing at least a first side, a second side, a first end, and a second end of the packaging material to be folded to form a cavity in which the one or more items reside, wherein a first pin extends and engages with the first end to fold the first end of the packaging material, and a second pin extends and engages with the second end to fold the second end of the packaging material;

causing the first side and the second side to be folded to form a tube-like structure around the one or more items;

causing the first side and the second side to be sealed to one another;

causing the first end and the second end to remain folded as the packaging material is conveyed to a sealing mechanism in a direction of travel; and causing the sealing mechanism to enclose the cavity along the first end and the second end.

2. The method of claim 1, wherein the one or more items are deposited onto the packaging material from a tote, further comprising causing the tote to be transitioned in a direction away from the packaging material at least partially contemporaneously with causing the packaging material to be folded to form the cavity.

3. The method of claim 2, wherein when the one or more items are deposited onto the packaging material from the tote, the one or more items are in contact with a portion of the tote to constrain the one or more items on the packaging material.

4. The method of claim 2, further comprising:

causing a plurality of third creases to be formed within the packaging material; and causing a plurality of fourth creases to be formed within the packaging material, wherein:

individual first creases of the plurality of first creases are a same as one another, individual second creases of the plurality of second creases are a same as one another, individual third creases of the plurality of third creases are a same as one another, and individual fourth creases of the plurality of fourth creases are a same as one another.

5. The method of claim 4, wherein:

the individual first creases extend between the first end and the second end;

at least two of the individual second creases are disposed proximate to the first end;

at least two of the individual second creases are disposed proximate to the second end;

at least two of the individual third creases are disposed proximate to the first end;

at least two of the individual third creases are disposed proximate to the second end;

at least two of the individual fourth creases are disposed proximate to the first end; and at least two of the individual fourth creases are disposed proximate to the second end.

6. The method of claim 4, wherein:

the individual third creases include:

a first segment arranged parallel to the direction of travel, and a second segment extending from the first segment, transverse to the direction of travel; and the individual fourth creases include:

a third segment arranged parallel to the direction of travel, the third segment being longer in length than the first segment, and a fourth segment extending from the third segment, transverse to the direction of travel.

7. The method of claim 6, wherein:

the at least two of the individual third creases disposed proximate to the first end intersect the individual second creases disposed proximate to the first end;

the at least two of the individual third creases disposed proximate to the second end intersect the individual second creases disposed proximate to the second end;

the at least two of the individual fourth creases disposed proximate to the first end intersect the individual second creases disposed proximate to the first end; and the at least two of the individual fourth creases disposed proximate to the second end intersect the individual second creases disposed proximate to the second end.

8. The method of claim 1, wherein:

the first pin engages with the first end to keep the first end folded as the packaging material is conveyed to the sealing mechanism; and the second pin engages with the second end to keep the second end folded as the packaging material is conveyed to the sealing mechanism.

9. The method of claim 1, further comprising determining one or more dimensions of the one or more items, wherein a location of the plurality of first creases and the plurality of second creases formed on the packaging material are based at least in part on the one or more dimensions.

10. A system, comprising:

one or more processors; and one or more non-transitory computer-readable media storing computer-executable instructions that, when executed by the one or more processors, cause the one or more processors to perform operations comprising:

causing, via a cutting mechanism, creases to be formed within a packaging material, causing one or more items to be deposited on the packaging material, causing, via a folding mechanism, at least a first side and a second side of the packaging material to be folded to at least partially form a bowl-like structure in which the one or more items are retained, causing, via a conveyance mechanism, at least a first end and a second end of the packaging material to be folded to at least partially form the bowl-like structure, wherein a first pin of the conveyance mechanism extends and engages with the first end to fold the first end, and a second pin of the conveyance mechanism extends and engages with the second end to fold the second end, causing the first side and the second side to be sealed, causing, via the conveyance mechanism, the packaging material to be conveyed to a sealing mechanism, and causing, via the sealing mechanism, the first end and the second end to be sealed.

11. The system of claim 10, wherein:

as the conveyance mechanism conveys the packaging material to the sealing mechanism, the first pin remains engaged with the first end to prevent the first end from unfolding, and the second pin remains engaged with the second end to prevent the second end from unfolding.

12. The system of claim 11, wherein the sealing mechanism includes fingers, the operations further comprising:

causing the fingers to engage with the packaging material, the fingers preventing the first end and the second end from unfolding; and causing the first pin and the second pin to retract.

13. The system of claim 10, wherein:

the creases include first creases and second creases;

the first creases include:

a first segment, and a second segment that extends transverse to the first segment; and the second creases include:

a third segment, and a fourth segment that extends transverse to the third segment.

14. The system of claim 13, wherein:

the creases include third creases and fourth creases;

the third creases that extend parallel to the first segment and the third segment;

the fourth creases include:

a fifth segment, a sixth segment that extends transverse to the fifth segment, and a seventh segment that extends transverse to the fifth segment;

the second segment intersects the seventh segment; and the fourth segment intersects the seventh segment.

15. The system of claim 10, wherein the one or more items are deposited onto the packaging material from a tote, the operations further comprising causing the tote to be transitioned in a direction away from the packaging material at least partially contemporaneously with:

causing the at least the first side and the second side to be folded to at least partially form the bowl-like structure; and causing the at least the first end and the second end to be folded to at least partially form the bowl-like structure.

16. The system of claim 10, the operations further comprising determining one or more dimensions of the one or more items, wherein a location of at least one of the creases formed on the packaging material is based at least in part on the one or more dimensions.

17. A method comprising:

causing, via a cutting mechanism, a plurality of creases to be formed within a packaging material;

causing one or more items to be deposited onto the packaging material;

causing at least a first side, a second side, a first end, and a second end of the packaging material to be partially folded along the plurality of creases to form a cavity in which the one or more items reside, wherein a first pin extends and engages with the first end to partially fold the first end of the packaging material, and a second pin extends and engages with the second end to partially fold the second end of the packaging material;

causing, via a folding mechanism, the first side and the second side of the packaging material to be folded around the one or more items;

causing the first side and the second side to be sealed;

causing, via a conveyance mechanism, the packaging material to be conveyed to a sealing mechanism, and causing, via the sealing mechanism, the first end and the second end to be sealed.

18. The method of claim 17, wherein the one or more items are deposited onto the packaging material from a tote, further comprising causing the tote to move in a direction away from the packaging material at least partially contemporaneously with causing the packaging material to be partially folded to form the cavity.

19. The method of claim 17, further comprising causing, via the first pin and the second pin of the conveyance mechanism, the first end and the second end to be at least partially folded.

20. The method of claim 17, further comprising determining at least one dimension of the one or more items, wherein a location of the plurality of creases are based at least in part on the at least one dimension.

* * * * *